US008517508B2

(12) United States Patent
Amidon, Jr. et al.

(10) Patent No.: US 8,517,508 B2
(45) Date of Patent: Aug. 27, 2013

(54) POSITIONING JETTING ASSEMBLIES

(75) Inventors: Frederick H. Amidon, Jr., Cornish, NH (US); David A. Brady, Plainfield, NH (US); Marc K. Torrey, Windsor, VT (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 523 days.

(21) Appl. No.: 12/496,874

(22) Filed: Jul. 2, 2009

(65) Prior Publication Data

US 2011/0001780 A1 Jan. 6, 2011

(51) Int. Cl.
*B41J 2/155* (2006.01)

(52) U.S. Cl.
USPC ..... 347/40; 347/49

(58) Field of Classification Search
USPC ..... 347/9, 40, 42, 49
See application file for complete search history.

(56) References Cited

U.S. PATENT DOCUMENTS

| | | | |
|---|---|---|---|
| 4,179,620 | A | 12/1979 | Agulnek |
| 4,433,341 | A | 2/1984 | Thomas |
| 4,527,175 | A | 7/1985 | Kojima et al. |
| 4,529,445 | A | 7/1985 | Buschow |
| 4,661,458 | A | 4/1987 | Berry et al. |
| 4,680,696 | A | 7/1987 | Eminuma et al. |
| 4,825,227 | A | 4/1989 | Fishbeck et al. |
| 4,929,963 | A | 5/1990 | Balazar |
| 4,937,598 | A | 6/1990 | Hine |
| 4,940,998 | A | 7/1990 | Asakawa |
| 5,265,315 | A | 11/1993 | Hoisington et al. |
| 5,365,843 | A | 11/1994 | House et al. |
| 5,461,405 | A | 10/1995 | Lehmann et al. |
| 5,489,930 | A | 2/1996 | Anderson |
| 5,546,109 | A | 8/1996 | Nakano |
| 5,610,645 | A | 3/1997 | Moore et al. |
| 5,646,658 | A | 7/1997 | Thiel et al. |
| 5,724,082 | A | 3/1998 | Moynihan |
| 5,751,300 | A | 5/1998 | Cowger et al. |
| 5,782,184 | A | 7/1998 | Albertalli et al. |
| 5,831,654 | A | 11/1998 | Colombat et al. |

(Continued)

FOREIGN PATENT DOCUMENTS

| | | | |
|---|---|---|---|
| CN | 1980795 | A | 6/2007 |
| CN | 1984780 | A | 6/2007 |

(Continued)

OTHER PUBLICATIONS

Machine-generated translation of JP 9-201957, published on May 1997.*

(Continued)

*Primary Examiner* — Huan Tran
(74) *Attorney, Agent, or Firm* — Fish & Richardson P.C.

(57) ABSTRACT

Among other things, in one aspect, an apparatus comprises features to enable mounting first and second jetting assemblies on a frame. The features comprise first and second alignment datums pre-fixed with respect to the frame for establishing respective positions of the first and second jetting assemblies, when mounted, so that at least some of the nozzles along a length of one of the jetting assemblies have predetermined offsets relative to at least some of the nozzles along a length of the other of the jetting assemblies, and an opening exposing all of the nozzles along the lengths of the first and second jetting assemblies are exposed to permit jetting of a fluid onto a substrate.

36 Claims, 13 Drawing Sheets

(56) References Cited

U.S. PATENT DOCUMENTS

| | | | |
|---|---|---|---|
| 5,871,292 | A | 2/1999 | Johnson et al. |
| 5,885,455 | A | 3/1999 | Graus et al. |
| 5,936,650 | A | 8/1999 | Ouchida et al. |
| 5,939,816 | A | 8/1999 | Culp |
| 6,000,792 | A | 12/1999 | Koizumi et al. |
| 6,068,367 | A | 5/2000 | Fabbri et al. |
| 6,084,618 | A | 7/2000 | Baker et al. |
| 6,152,559 | A | 11/2000 | Kojima et al. |
| 6,217,164 | B1 | 4/2001 | Hino |
| 6,224,709 | B1 | 5/2001 | Takemoto et al. |
| 6,227,645 | B1 | 5/2001 | Takahashi et al. |
| 6,350,013 | B1 | 2/2002 | Scheffelin et al. |
| 6,382,778 | B1 | 5/2002 | Iijima et al. |
| 6,391,193 | B1 | 5/2002 | Luka |
| 6,406,137 | B1 | 6/2002 | Okazaki et al. |
| 6,428,141 | B1 | 8/2002 | McElfresh et al. |
| 6,457,811 | B1 | 10/2002 | Pan et al. |
| 6,467,874 | B1 | 10/2002 | Williams et al. |
| 6,499,823 | B2 | 12/2002 | Okazaki et al. |
| 6,502,921 | B2 | 1/2003 | Kanda et al. |
| 6,554,398 | B2 | 4/2003 | Wyngaert et al. |
| 6,609,778 | B2 | 8/2003 | Ingham et al. |
| 6,631,978 | B1 | 10/2003 | Watanabe et al. |
| 6,634,742 | B2 | 10/2003 | Owaki et al. |
| 6,652,083 | B2 | 11/2003 | Ison et al. |
| 6,655,786 | B1 | 12/2003 | Foote et al. |
| 6,659,590 | B2 | 12/2003 | Silverbrook |
| 6,672,706 | B2 | 1/2004 | Silverbrook |
| 6,672,707 | B2 | 1/2004 | Silverbrook |
| 6,685,299 | B2 | 2/2004 | Hirota |
| 6,715,863 | B2 | 4/2004 | Shimizu |
| 6,752,493 | B2 | 6/2004 | Dowell et al. |
| 6,796,630 | B2 | 9/2004 | Ison et al. |
| 6,869,167 | B2 | 3/2005 | Silverbrook |
| 7,052,117 | B2 | 5/2006 | Bibl et al. |
| 7,246,888 | B2 | 7/2007 | Akahane et al. |
| 7,322,675 | B2 | 1/2008 | Silverbrook |
| 7,334,886 | B2 | 2/2008 | Papaiacovou et al. |
| 7,387,366 | B2 | 6/2008 | Ingham et al. |
| 7,413,284 | B2 | 8/2008 | Higginson et al. |
| 7,413,300 | B2 | 8/2008 | von Essen et al. |
| 7,416,126 | B2 | 8/2008 | Wittenberg et al. |
| 7,427,332 | B2 | 9/2008 | Takemoto et al. |
| 7,448,741 | B2 | 11/2008 | von Essen |
| D588,632 | S | 3/2009 | Kamimura et al. |
| 7,527,347 | B2 | 5/2009 | Mukai |
| 7,527,377 | B2 | 5/2009 | Divo |
| 7,566,118 | B2 | 7/2009 | Bibl et al. |
| D600,744 | S | 9/2009 | Kim |
| 7,658,460 | B2 | 2/2010 | Aoki |
| 7,665,815 | B2 * | 2/2010 | Swett et al. ..... 347/9 |
| 7,748,830 | B2 | 7/2010 | Platt et al. |
| D621,871 | S | 8/2010 | Maeshima et al. |
| D624,584 | S | 9/2010 | Park et al. |
| 7,810,902 | B2 | 10/2010 | Silverbrook |
| D626,589 | S | 11/2010 | Domae |
| 7,824,021 | B2 | 11/2010 | Silverbrook |
| D652,446 | S | 1/2012 | Brady et al. |
| D653,284 | S | 1/2012 | Amidon, Jr. et al. |
| 2002/0024554 | A1 | 2/2002 | Tominaga |
| 2002/0180835 | A1 | 12/2002 | Boyd et al. |
| 2003/0202040 | A1 | 10/2003 | Shade |
| 2003/0227516 | A1 | 12/2003 | Yamaguchi et al. |
| 2003/0234845 | A1 | 12/2003 | Tominaga et al. |
| 2004/0021735 | A1 | 2/2004 | Horii et al. |
| 2004/0224102 | A1 | 11/2004 | Ebihara |
| 2005/0157073 | A1 | 7/2005 | Silverbrook et al. |
| 2005/0270329 | A1 | 12/2005 | Hoisington et al. |
| 2005/0280678 | A1 | 12/2005 | Bibl et al. |
| 2006/0250493 | A1 | 11/2006 | Silverbrook et al. |
| 2008/0211872 | A1 | 9/2008 | Hoisington et al. |
| 2011/0001780 | A1 | 1/2011 | Amidon, Jr. et al. |

FOREIGN PATENT DOCUMENTS

| | | | |
|---|---|---|---|
| CN | 1997521 | A | 7/2007 |
| EP | 0 383 558 | | 8/1990 |
| EP | 0666177 | | 8/1995 |
| EP | 1186416 | | 3/2002 |
| EP | 1238813 | | 9/2002 |
| EP | 1258354 | A2 | 11/2002 |
| EP | 1 336 486 | | 8/2003 |
| JP | 61205154 | A | 9/1986 |
| JP | 07017050 | | 1/1995 |
| JP | 7186386 | A | 7/1995 |
| JP | H9-201957 | | 8/1997 |
| JP | H10-309801 | | 11/1998 |
| JP | 11277734 | A | 10/1999 |
| JP | 2001-162811 | | 6/2001 |
| JP | 2001260366 | A | 9/2001 |
| JP | 2002067343 | | 3/2002 |
| JP | 2002-264311 | | 9/2002 |
| JP | 2003502879 | A | 1/2003 |
| JP | 2003-154724 | | 5/2003 |
| JP | 2003127385 | | 5/2003 |
| JP | 2007511058 | A | 4/2007 |
| JP | 2007-535434 | | 12/2007 |
| JP | 2007535431 | | 12/2007 |
| JP | 2007535433 | | 12/2007 |
| KR | 2007-0007379 | | 1/2007 |
| KR | 20070007202 | | 1/2007 |
| KR | 20070012846 | | 1/2007 |
| WO | 2005/108095 | | 11/2005 |
| WO | 2005108094 | | 11/2005 |
| WO | 2005108097 | A | 11/2005 |

OTHER PUBLICATIONS

Machine-generated translation of JP 2003-154724, published on May 2003.*

Machine-generated translation of JP 2001-162811, published on Jun. 2001.*

Office Action from co-pending Chinese App 200580017004.x dated Dec. 26, 2008.

International Preliminary Report on Patentability from International Application No. PCTUS2005/015028 dated Nov. 9, 2006.

International Search Report for PCT/US2005/015028, Dec. 6, 2005.

Office Action from co-pending Chinese Application No. 2005800201298 dated Apr. 24, 2009.

International Preliminary Report on Patentability from International Application No. PCT/US2005/14952 dated Nov. 9, 2006.

International Search Report for PCT/US2005/14952 dated Aug. 22, 2005.

International Preliminary Report on Patentability from International Application No. PCTUS2005/014999 dated Nov. 9, 2006.

International Search Report for PCT/US2005/014999, Oct. 6, 2005.

Office Action from Chinese Application No. 200580019821.9 dated Sep. 12, 2008.

U.S. Appl. No. 29/339,562, filed Jul. 2, 2009, including application as filed and transaction history (PTO website).

U.S. Appl. No. 29/339,564, filed Jul. 2, 2009, including application as filed and transaction history (PTO website).

Office Action from Chinese Application No. 200580019821.9 dated Oct. 23, 2009, 8 pages.

Office Action from European Application No. 05745034.8 dated Nov. 19, 2009, 3 pages.

Office Action dated Jan. 22, 2010 from co-pending Chinese application No. 200580017004.x, 7 pages.

Office Action dated Jan. 8, 2010 from co-pending Chinese applicaion No. 2005800201298, 6 pages.

Office Action dated Nov. 19, 2009 from co-pending European application No. 05745034.8, 3 pages.

Office Action dated Jun. 2, 2010 from co-pending Chinese application No. 2005800201298, 11 pages.

Office Action dated Feb. 26, 2010 from co-pending European application No. 05745124.7, 3 pages.

International Search Report from corresponding PCT application No. PCT/US2005/014999, mailed Oct. 6, 2005, 11 pages.
International Search Report from corresponding PCT application No. PCT/US2005/015028, mailed Dec. 6, 2005, 15 pages.
Office Action dated Aug. 3, 2010 from co-pending Japanese application No. 2007-511048, 17 pages.
International Search Report and Written Opinion dated Feb. 23, 2011 issued in International Application No. PCT/US2010/040339, 10 pages.
Office Action issued from Japanese Application No. 2007-511048 dated Sep. 13, 2011, 4 pages.
Office Action issued from Japanese Application No. 2007-511088 dated Dec. 28, 2010, 6 pages.
Office Action issued from Japanese Application No. 2007-511041 dated Feb. 25, 2011, 4 pages.
Notification Concerning Transmittal of International Preliminary Report of Patentability for related PCT Application No. PCT/US2010/040339, mailed Jan. 12, 2012, 6 pages.
Office Action from Korean Patent Office from corresponding Application No. 10-2006-7025318, dated Jan. 18, 2012, 8 pages.
Office Action from Korean Patent Office from corresponding Application No. 10-2006-7025319, dated Dec. 12, 2011, 7 pages.
Office Action from Korean Patent Office from corresponding Application No. 10-2006-7025317, dated Jan. 18, 2012, 9 pages.
Office Action issued from Japanese application No. 2007-511048 mailed Jan. 24, 2013, 9 pages.
Office Action issued from Japanese application No. 2007-511048 mailed Jul. 3, 2012, 6 pages.

* cited by examiner

POSITIONING JETTING ASSEMBLIES

TECHNICAL FIELD

This description relates to positioning jetting assemblies.

BACKGROUND

An ink jet printer can include one or more jetting assemblies, each capable of jetting ink from nozzles that are connected to corresponding pumping chambers. Jetting of ink from a chamber can be triggered by a piezoelectric actuator adjacent to the pumping chamber. To precisely print an image having a high resolution, the jetting assemblies need to be positioned in the printer with a high precision relative to each other and relative to the ink jet printer.

SUMMARY

In one aspect, an apparatus comprises features to enable mounting first and second jetting assemblies on a frame. The features comprise first and second alignment datums pre-fixed with respect to the frame for establishing respective positions of the first and second jetting assemblies, when mounted, so that at least some of the nozzles along a length of one of the jetting assemblies have predetermined offsets relative to at least some of the nozzles along a length of the other of the jetting assemblies, and an opening exposing all of the nozzles along the lengths of the first and second jetting assemblies are exposed to permit jetting of a fluid onto a substrate.

Implementations may include one or more of the following features. The features also include at least one fastener for the jetting assemblies. The fastener includes a piece to fix the fastener to the apparatus and a resilient piece to exert forces on the jetting assemblies. The fastener comprises a screw. The resilient piece comprises a spring. The fastener imposes no torque on the jetting assemblies. The frame is coated with a Teflon-nickel coating. The coating includes a homogeneous mixture of Teflon and nickel. The coating has a thickness of about 2 microns to about 8 microns. The features also include at least one flexure corresponding to the first or second alignment datum. The features also include additional alignment datums for establishing respective positions of the jetting assemblies along a direction perpendicular to the length of the jetting assemblies.

In another aspect, an apparatus comprises a support for mounting a jetting assembly to permit jetting of a fluid from the nozzles onto a substrate in a jetting direction, and a fastener that applies a force on the jetting assembly in the jetting direction to hold the jetting assembly firmly against a precision surface of the support in at least one point, the fastener permitting torque-free motion of at least a portion of the jetting assembly, relative to the support, around an axis that lies in the direction of jetting.

Implementations may include one or more of the following features. The fastener includes a resilient element located between an end of the fastener and the jetting assembly. The resilient element is the only portion of the fastener that contacts the jetting assembly. The fastener comprises helical threads for fastening to the support. The resilient element exerts a force of about 2 pounds to about 10 pounds on the jetting assembly. The resilient element exerts a force of about 5 pounds on the jetting assembly.

In another aspect, an apparatus comprises a support for mounting a jetting assembly to permit jetting of a fluid from the nozzles, the support comprising an alignment datum at one end of the jetting assembly; and a resilient sheet metal flexure between the support and a second end of the jetting assembly, the flexure having a fastened end connected to a free end at a bend to exert a force along a length of the jetting assembly toward the alignment datum.

Implementations may include one or more of the following features. The flexure has a spring constant of about 200 pounds per inch to about 600 pounds per inch. The flexure exerts a force of about 5 pounds to about 20 pounds on the jetting assembly. The free end includes an additional bend that contacts the jetting assembly. The free end includes a distal end beyond the additional bend, the distal end extending in a direction opposite to the location of the jetting assembly. The distal end can be stopped by a stop surface on the support. The distal end of the free end is about 600 microns to about 1000 microns from a stop surface on the support. The additional bend is about 3.0 mm to about 3.3 mm from a surface of the fastened end.

In another aspect, an apparatus comprises a metallic support body for mounting a jetting assembly that jets a fluid, and a coating that is on the metallic support body and is thermally and electrically conductive and chemically resistant to the fluid.

Implementations may include one or more of the following features. The coating includes Teflon, nickel, chromium nickel nitride, or the combination of two or more of them. The coating includes a homogeneous mixture of nickel and Teflon. The coating has a thickness of about 2 microns to 10 microns. A surface of the coating has a friction coefficient of less than 0.35.

In another aspect, an apparatus comprises a support for a jetting assembly, the support comprising an alignment datum, and a jetting assembly. The jetting assembly comprises an array of nozzles that jet a fluid, and a bezel having at least one precision surface in contact with the alignment datum, the precision surface including a coating that is chemically resistant to the fluid.

Implementations may include one or more of the following features. The coating includes a mold releasing agent. The precision surface is a surface of a graphite layer. The bezel includes a hole through which a fastener can be applied to fasten the jetting assembly onto the support. The hole is free of threads and is free from contacting the fastener.

In another aspect, a method comprises forcing one end of a first jetting assembly against a first pre-fixed alignment datum of a support along a length of the first jetting assembly; and forcing one end of a second jetting assembly against a second pre-fixed alignment datum of a support along a length of the second jetting assembly so that at least some jetting nozzles of the first jetting assembly are offset relative to corresponding jetting nozzles of the second jetting assembly in a predetermined configuration, the first jetting assembly being in direct contact with the second jetting assembly.

Implementations may include one or more of the following features. Offset between the corresponding jetting nozzles of the first and second jetting assemblies is obtained without adjusting the first and second alignment datums. Another end of the first jetting assembly along the length of the first jetting assembly presses against a first flexure and another end of the second jetting assembly along the length of the second jetting assembly presses against a second flexure. The method also includes fastening the first and second jetting assemblies relative to the first and second alignment datums.

In another aspect, a method comprises forming a metallic support for mounting a jetting assembly so that jetting nozzles of the jetting assembly are exposed to permit jetting of a fluid from the nozzles onto a substrate in a jetting direction, and applying to a support a coating that is thermally and electrically conductive and chemically resistant to the ink. The coating can include a homogeneous mixture of Teflon and nickel.

In another aspect, an apparatus comprises an opening defined in a support for mounting a frame capable of carrying one or more jetting assemblies, and a first resilient element and a second resilient element arranged diagonally with respect to the opening to exert a first force and a second force on different surfaces of the frame, the first spring force being in an opposite direction to a direction of the second spring force to enable a rotation of the frame to be mounted on the support.

Implementations may include one or more of the following features. The apparatus also includes a first alignment datum corresponding to the first resilient element and a second, adjustable alignment datum corresponding to the second resilient element. The second alignment datum is movable along the direction of the first force. The second alignment datum comprises a contact point on a surface of a tapered cone. The apparatus also comprises alignment features located at opposite ends of the opening for linear adjustment of the frame. The alignment features comprise a spring plunger. The apparatus also includes fastening features for fastening the frame to the support. The fastening features comprise a spring plunger or a spring. The fastening is done without inducing a torque on the frame. The apparatus also comprises a first adjustment mechanism and a second adjustment mechanism located on the same end of the support, the first adjustment mechanism capable of adjusting a position of the frame linearly and the second adjustment mechanism capable of rotating the frame. The support further defines additional openings for mounting additional frames.

In another aspect, an apparatus comprises an opening defined in a support for mounting a frame capable of carrying one or more jetting assemblies, and a mechanism that is accessible from one side of the support for adjusting both a linear position of the frame and an angle of the frame relative to a direction of jetting.

Implementations may include one or more of the following features. The mechanism comprises an adjustment screw. The mechanism comprises a screw for adjusting a contact point on a surface of a tapered cone. The apparatus also includes one or more openings and one or more corresponding mechanisms, all mechanisms being accessible from one common end to all openings.

In another aspect, a method comprises seating a frame capable of carrying one or more jetting assemblies onto a support, the frame being in contact with alignment features of an adjustment mechanism, at least one of the alignment features relating to a direction parallel to an array of nozzles of the jetting assemblies, and at least another one of the alignment features relating to a direction perpendicular to the parallel direction, and accessing the adjustment mechanism from an edge of the support to linearly adjust a position of the frame along the parallel direction, and to adjust an angular orientation of the frame relative to the parallel and perpendicular directions.

The at least another one of the alignment features can include resilient elements arranged diagonally relative to the frame.

In another aspect, an apparatus comprises an opening defined in a support for mounting a frame capable of carrying one or more jetting assemblies onto the support, and a tapered cone having a surface to be in contact with an edge of the frame, the tapered cone movable linearly along a first direction and capable of moving the edge of the frame along a second direction perpendicular to the first direction.

Implementations may include one or more of the following features. The surface of the tapered cone and the edge of the frame are in point contact. The movement of the edge of the frame along the second direction induces a rotation of the frame.

In another aspect, a method comprises inserting a frame capable of carrying one or more jetting assemblies onto a support, the frame having an edge in contact with a surface of a tapered cone attached to the frame; and moving the edge of the frame along a first direction by adjusting the linear position of the tapered cone along a second direction perpendicular to the first direction. The he edge of the frame and the surface can be in point contact.

These and other aspects and features, and combinations of them, can be expressed as methods, apparatus, systems, means for performing a function, and in other ways.

Other features and advantages will be apparent from the following detailed description, and from the claims.

DESCRIPTION

Figure 7:
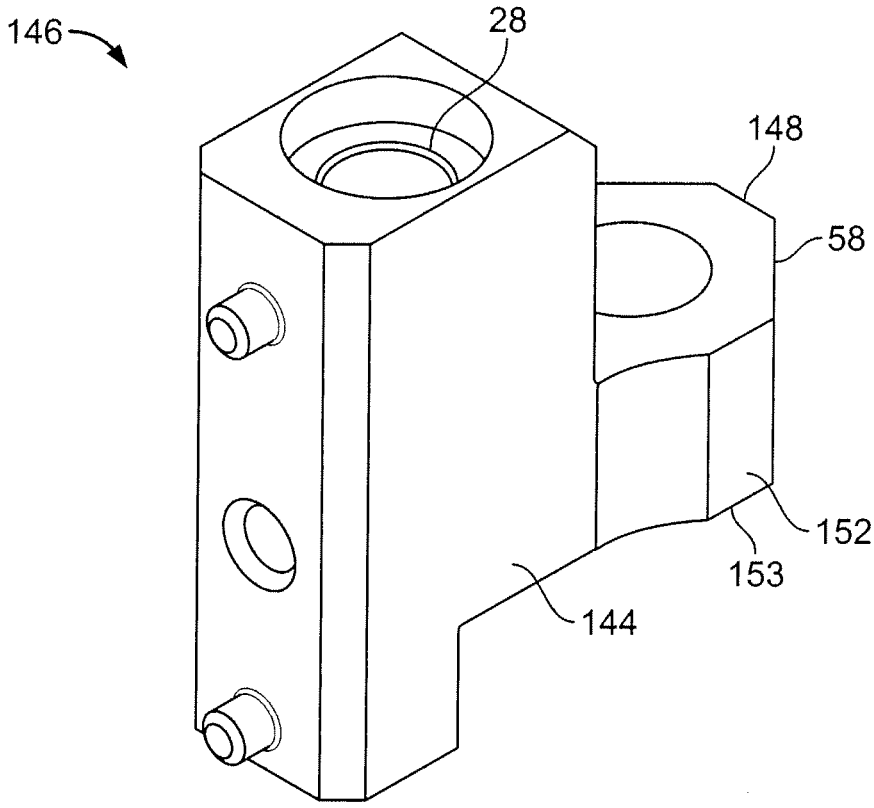
Figure 8:
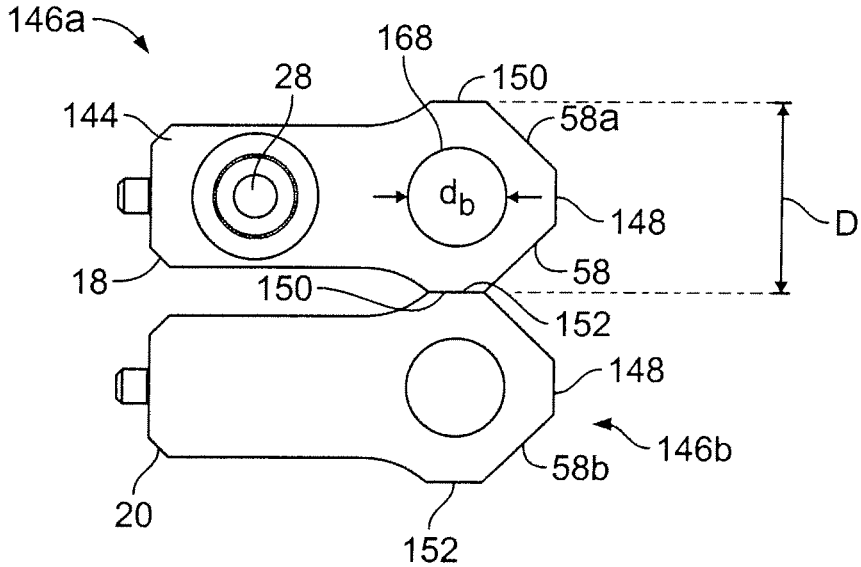
Figure 9:
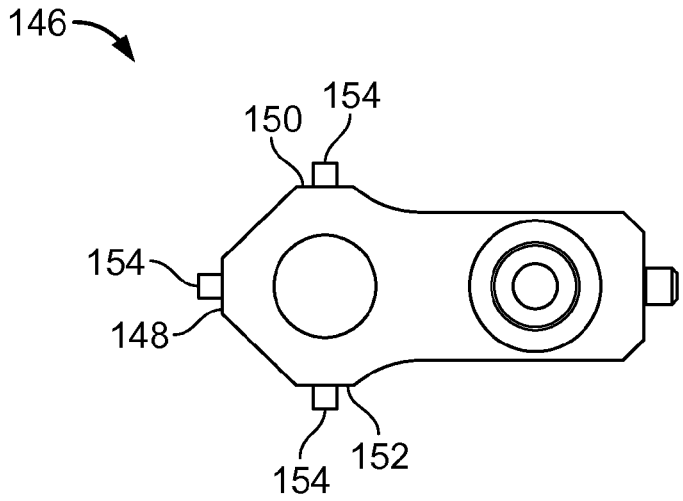

FIGS. 7, 8, and 9 are respectively perspective and top views of portions of a jetting assembly.

Figure 10:
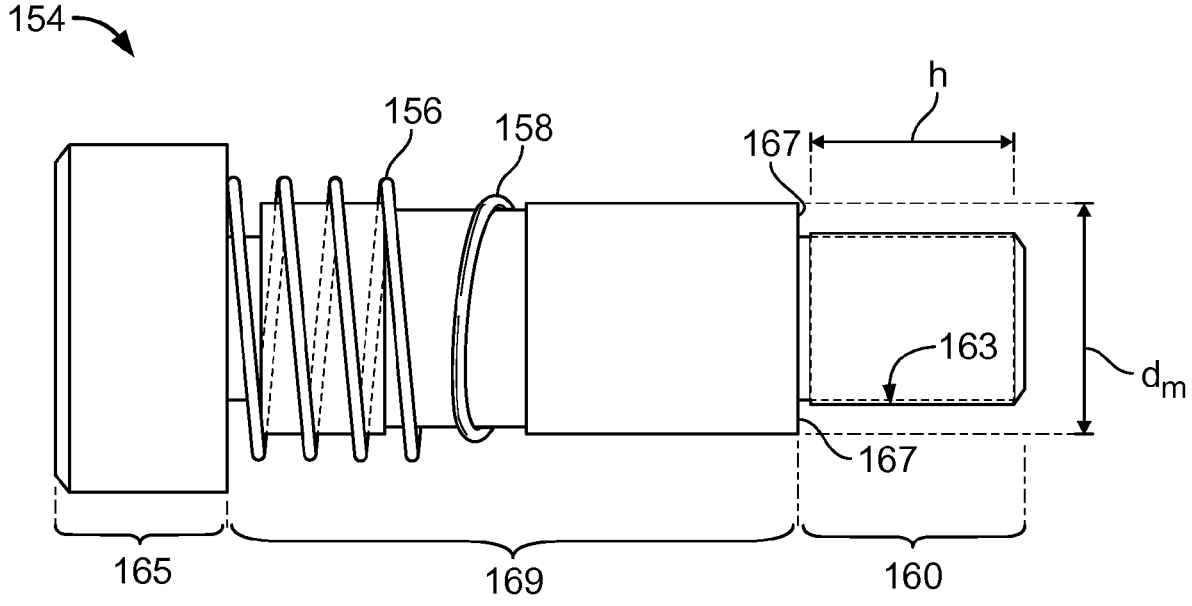

FIG. 10 is a side view of a fastener.

Figure 11:
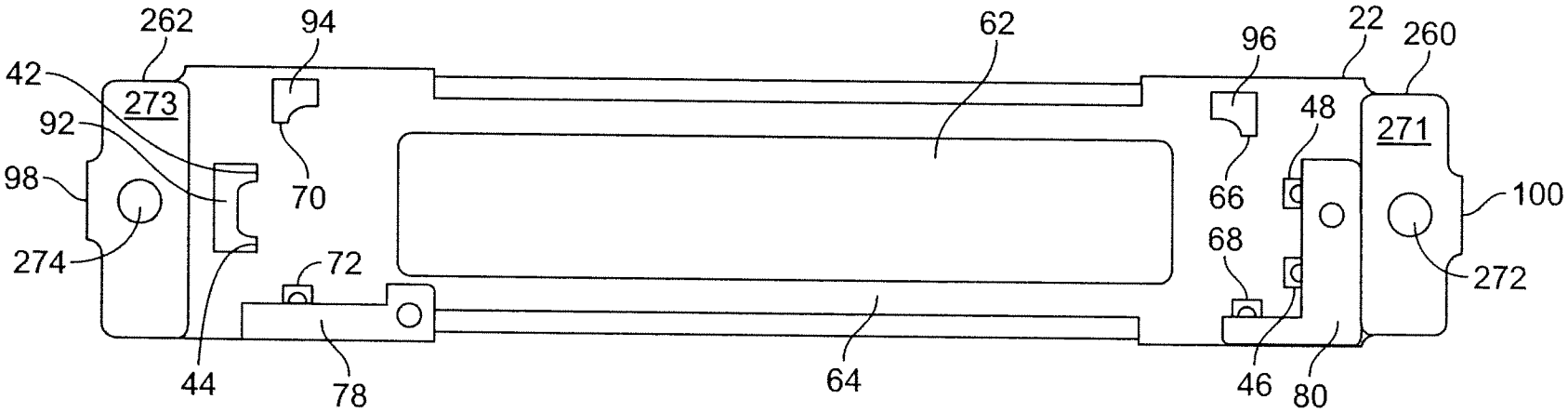

FIG. 11 is a top view of the frame.

Figure 12:
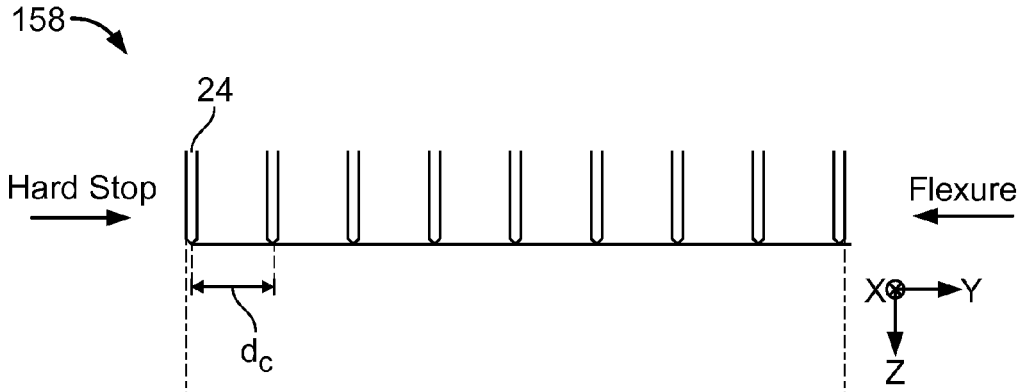
Figure 13:
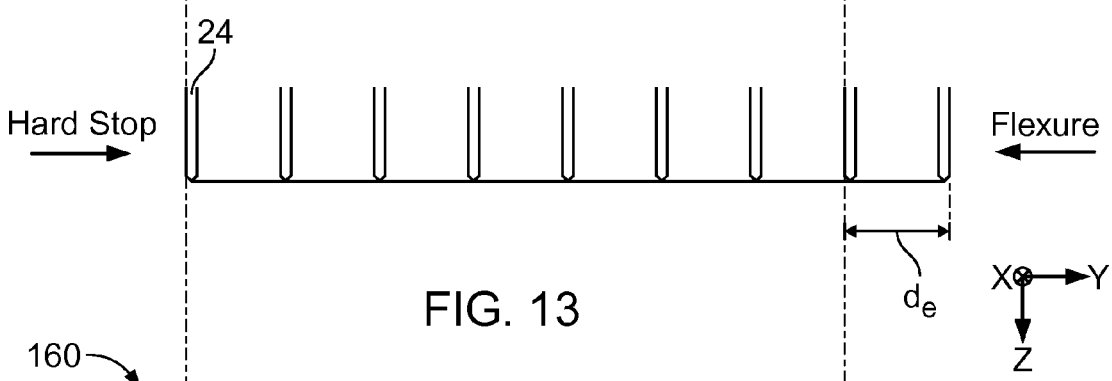
Figure 14:
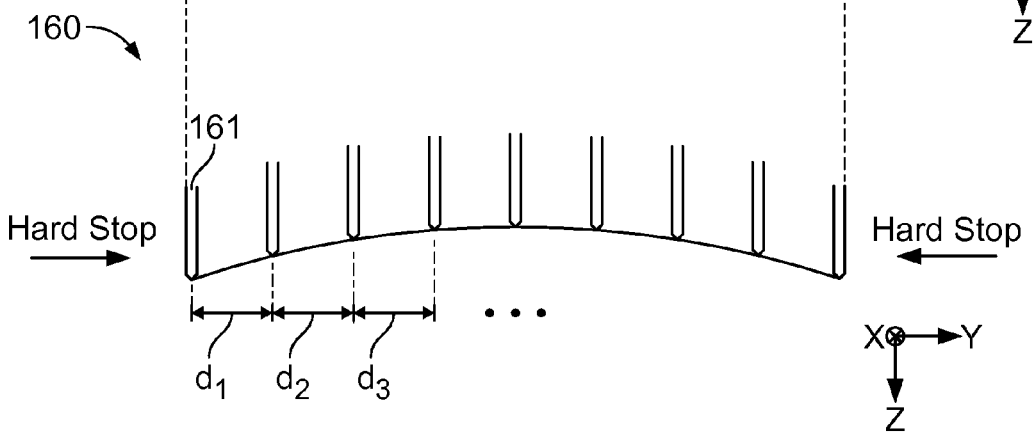

FIGS. 12, 13, and 14 are schematic side views of arrays of pumping chambers and nozzles (not to scale).

Figure 15:
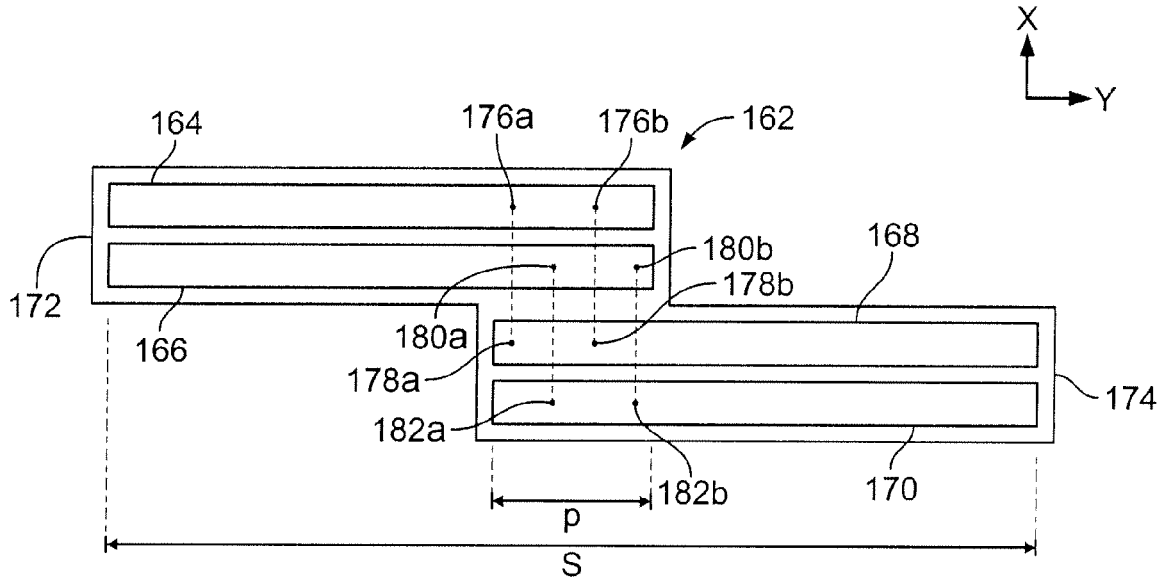

FIG. 15 is a schematic bottom view of a jetting module (not to scale).

Figure 16:
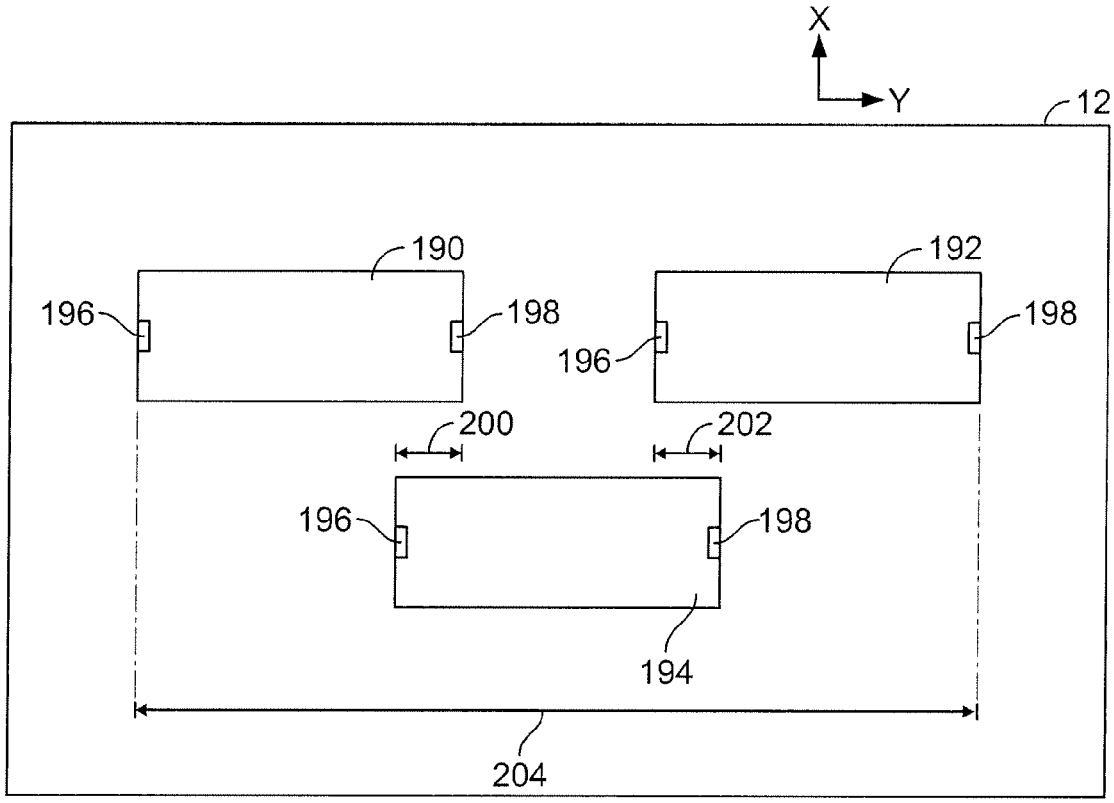
Figure 17:
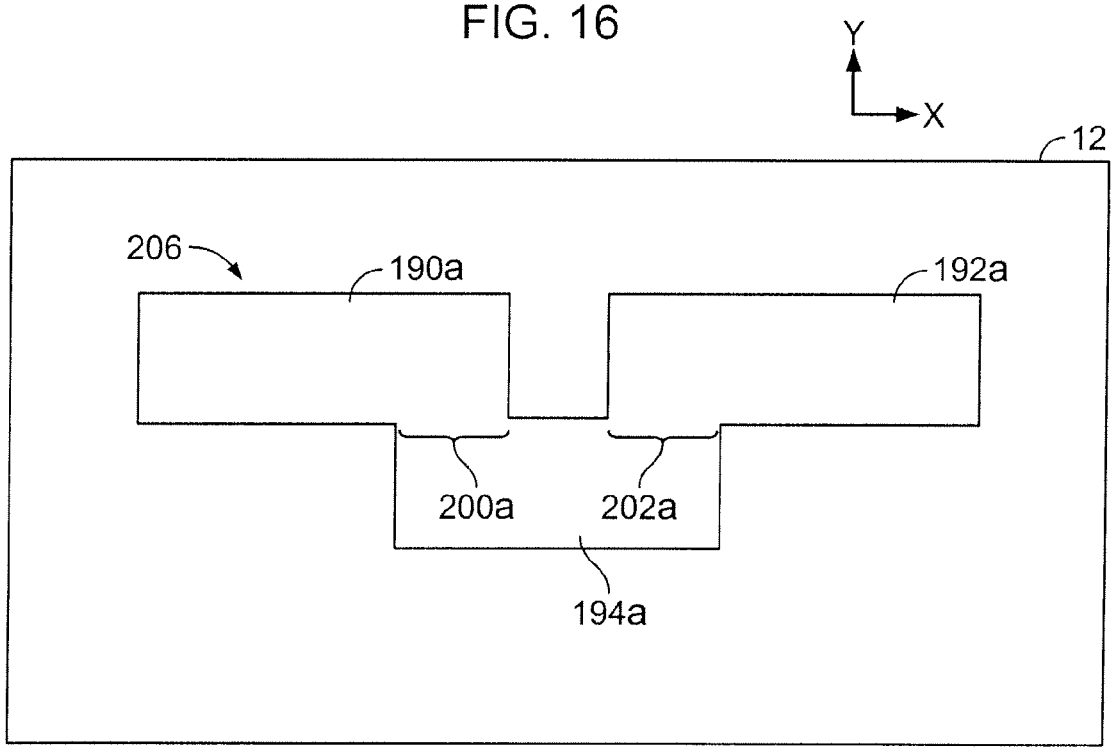
Figure 19:
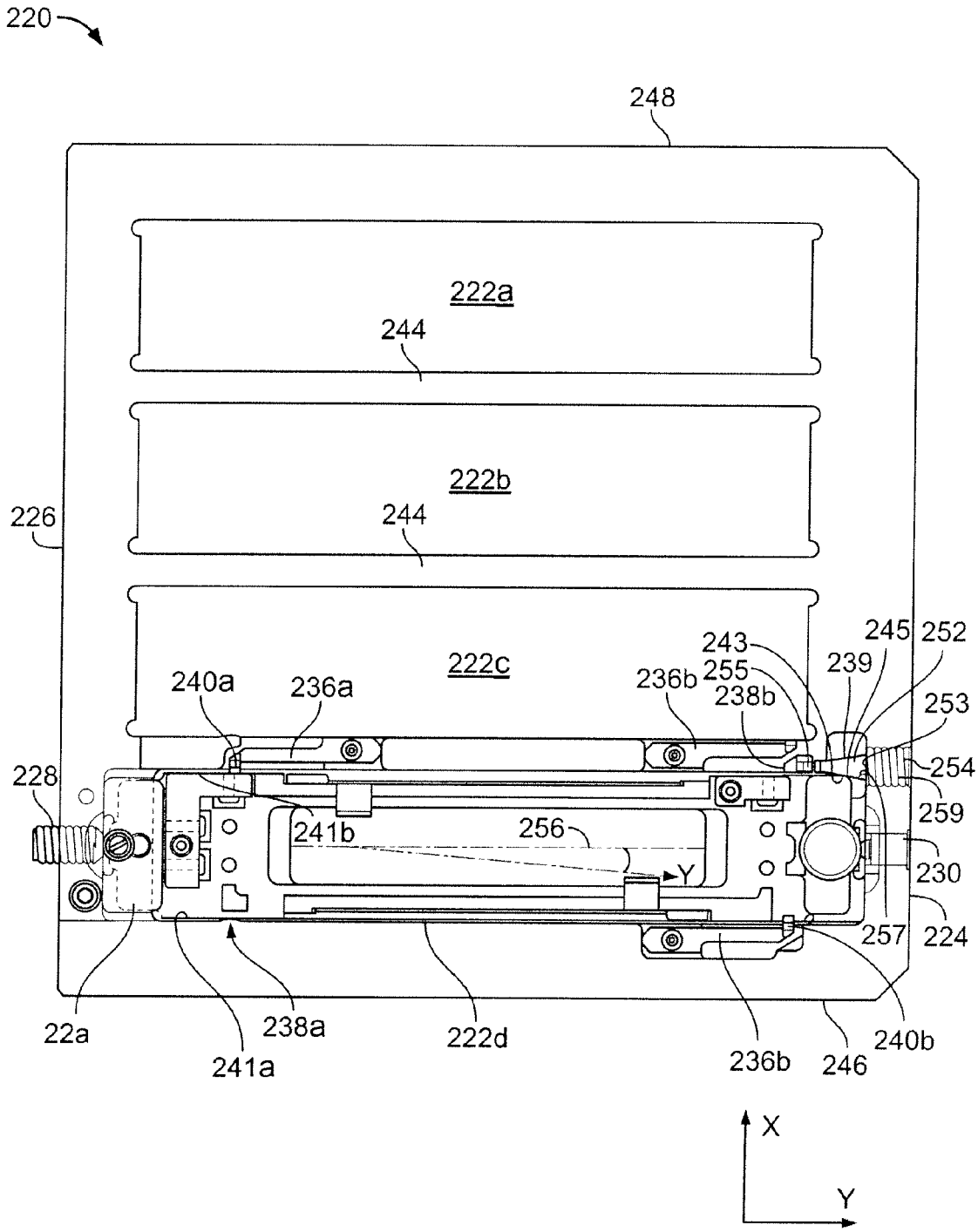

FIGS. 16, 17 and 19 are schematic top views of printbars.

Figure 18:
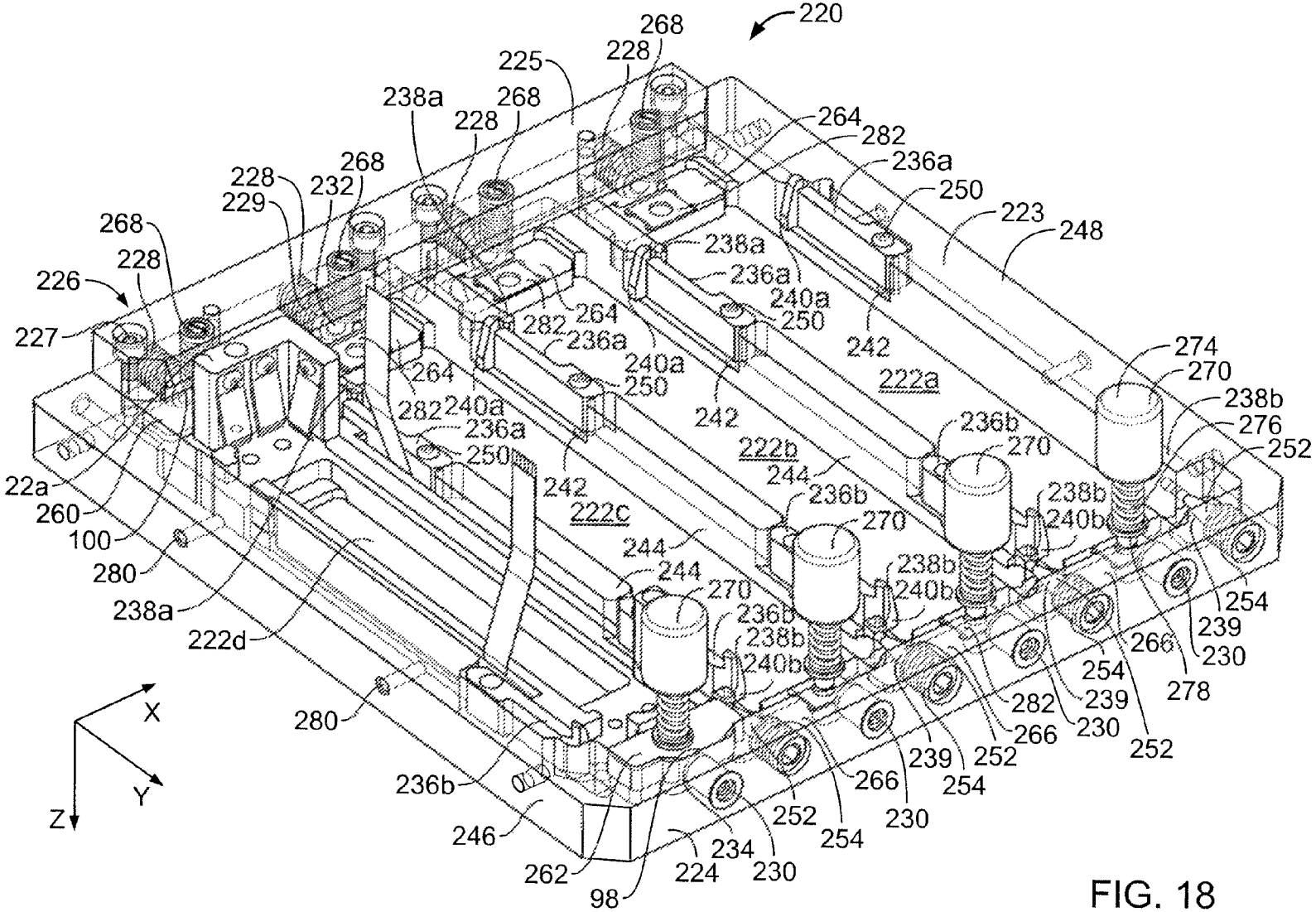

FIG. 18 is a schematic perspective view of a printbar.

Figure 1:
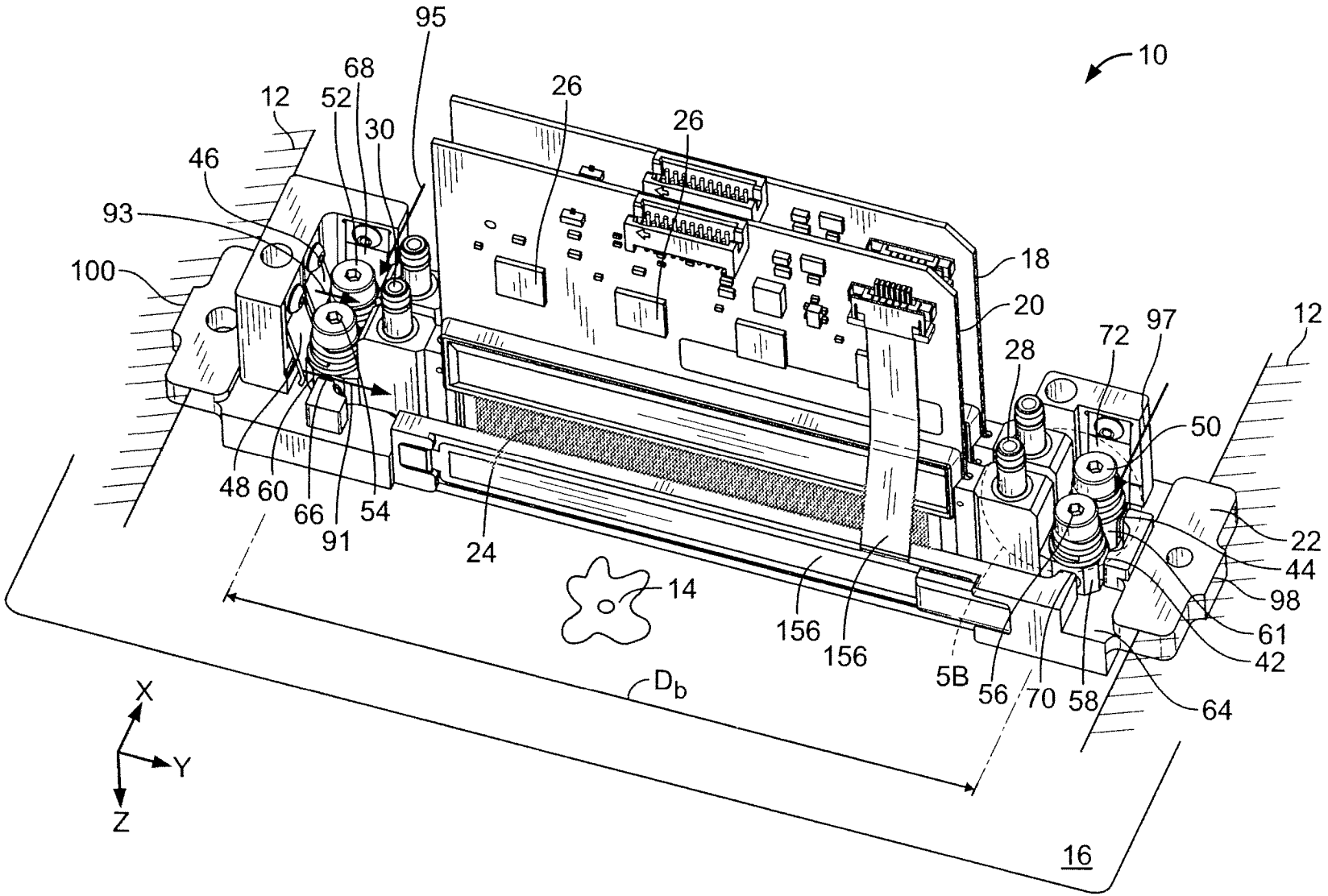
FIG. 1 is a perspective view of a jetting module.

One or more jetting modules 10 shown in FIG. 1 (only one module is shown in FIG. 1) can be positioned onto a printbar 12 of a printer (not shown) to print an image 14 on a substrate 16 that lies adjacent (e.g., vertically beneath) the jetting module 10 along a z direction. The jetting module 10 includes two jetting assemblies 18, 20 precisely positioned adjacent, parallel to, and slightly offset along a y direction relative to one another on a frame 22. The jetting module 10 can print with a high precision at a resolution higher than a resolution at which each jetting assembly 18, 20 prints alone. Each jetting assembly 18, 20 includes one or more arrays of (e.g., rows of parallel) pumping chambers 24 that are actuated by piezoelectric elements that cover the pumping chambers (not shown). The piezoelectric elements can be activated by signals from integrated circuits 26 to cause the corresponding pumping chamber 24 to jet ink that has been received at ink inlets 28, 30 from ink supplies (not shown) through one or more corresponding nozzles (FIG. 2) onto the substrate 16 to form the image 14.

Figure 2:
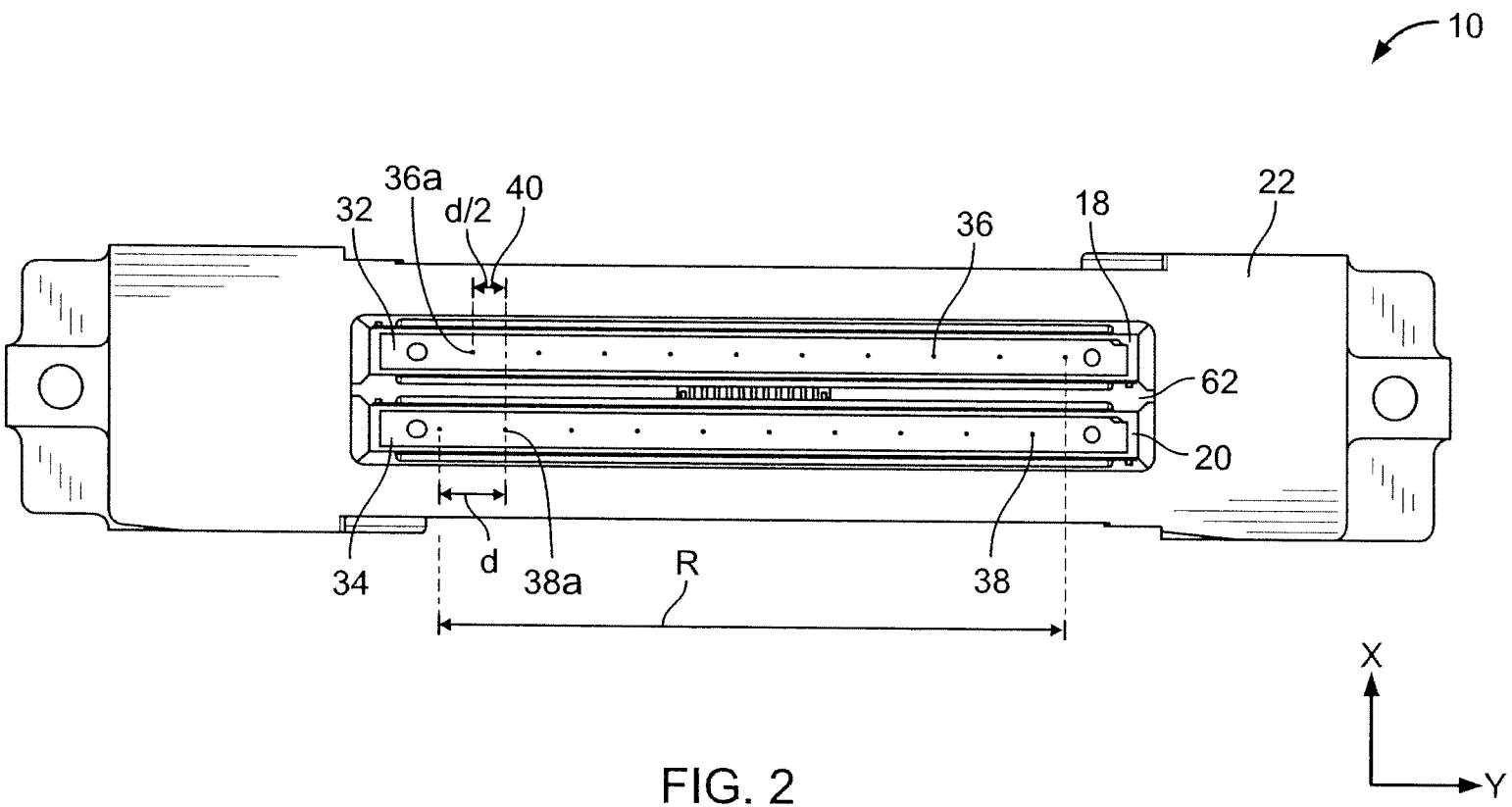
FIG. 2 is a bottom view of a jetting module (nozzle arrays are not to scale).

In the example shown in FIG. 2, coplanar bottom surfaces 32, 34 of the jetting assemblies 18, 20 each includes an array (e.g., a row) of evenly-spaced nozzles 36, 38 along the y direction (the spaces between nozzles are not to scale). Each nozzle is connected to one end of a corresponding pumping chamber 24 (FIG. 1) to receive ink that is pumped from that pumping chamber and deliver it to the substrate 16. Each array 36, 38 is capable of printing at a predetermined resolution (dots per inch or dpi) along the array direction (y direction) based on a distance d by which each nozzle in the array is separated from its neighboring nozzle(s). For example, d can range from about 0.0025 inches to about 0.02 inches and the jetting assembly 18, 20 can print at about 50 dpi to about 400 dpi. Each jetting assembly 18, 20 can include about 128 to about 512 nozzles. In the implementation shown in FIG. 2, the jetting assemblies 18, 20 are positioned such that a nozzle 36*a* in the nozzle array 36 is offset by an offset distance 40 of d/2 relative to a corresponding nozzle 38*a* in the nozzle array 38. Because of this offset, the jetting module 10 can effectively print at a resolution along they direction that is twice as high as a resolution at which each jetting assembly 18, 20 prints alone. For example, the jetting module 10 can print at about 100 dpi to about 800 dpi and cover a printing range R of about 64.5 mm to about 129 mm.

Referring again to FIG. 1, the frame 22 of the module carries alignment datums 42, 44, 66, 70 and flexures 46, 48, 68, 72 with pre-determined precisions. The alignment datums cooperate with alignment surfaces (not labeled in FIG. 1, see for example, surfaces 148, 150, 152 of FIG. 8) on bezels 58, 60, 61 (another bezel of the jetting assembly 18 not shown in FIG. 1) of the two jetting assemblies 18, 20, so that when the jetting assemblies 18, 20 are mounted onto the frame 22 and the flexures apply alignment forces 91, 93, 95, 97 (only schematically showing the directions of the forces) against the force-bearing surfaces of the bezels of the two jetting assemblies. The jetting assemblies become very precisely aligned and positioned and the jetting module 10 automatically is configured to print with a high precision at the desired resolution described with respect to FIG. 2. Because of the configurations of the module frame 22 and the jetting assembly bezels, and the precision with which the alignment datums and alignment surfaces are formed and located, no further positioning adjustment or testing is required for each of the jetting assemblies 18, 20 to achieve the desired precision and resolution associated with the jetting module 10. As a result, the arrays of nozzles can be positioned with a precision of ±15 microns or less in the x direction, ±15 microns or less in they direction, and ±65 microns or less, or ±35 microns or less in the z direction.

The module frame 22 is precisely designed and manufactured based on the intended values of parameters, such as types, dimensions, dpi, alignment precision, of the jetting assemblies. In particular, the jetting assemblies are precisely positioned relative to each other and relative to the frame along all three directions x, y, z. Along an x direction and perpendicular to they direction, the flexures 68, 72 push (through one or more of the force-bearing surfaces 148, 150, 152 of FIG. 8) the jetting assemblies 18, 20 against each other and against the corresponding alignment datums 66, 70 using the forces 95, 97. When assembled in the module, the jetting assemblies 18, 20 are in contact with each other only at surfaces 150, 152 of their respective bezels, e.g., bezels 58, 61 (FIG. 1), so that only the bezel surfaces affect the relative positioning of the two jetting assemblies along the x direction.

Along they direction, the flexures 46, 48 apply forces 91, 93 on the jetting assemblies 18, 20 against the alignment datums 42, 44. The offset distance 40 shown in FIG. 2 is provided by the design of alignment datums 42, 44 and the flexures 46, 48 (explained below). Along the z direction, the bottom surfaces 32, 34 (FIG. 2) of the jetting assemblies 18, 20 are substantially within the same plane. In some embodiments, the bottom surfaces 32, 34 are less than 120 microns, 100 microns, 80 microns, 60 microns, 40 microns, 20 microns, or even less apart from each other along the jetting direction z.

The jetting module 10 of FIG. 1 can be readily assembled. First, the jetting assembly 20 is pressed, e.g., spring loaded, along the z direction into a space between the alignment datum 44 and the flexure 46 to expose the nozzle array through an opening 62 (FIG. 2) of the frame 22. The jetting assembly 20 is inserted and pushed down until bottom surfaces (see e.g., surface 153 of FIG. 7) of bezels 58, 60 of the jetting assembly 20 are stopped by an upper surface 64 of the frame 22, and the jetting assembly 20 is positioned tightly between the alignment datum 44 and the flexure 46 along the y direction. Fasteners 54, 56 can be used to fasten the jetting assembly 20 onto the frame 22, for example, to prevent the jetting assembly 20 from popping up along the z direction.

The jetting assembly 18 can be mounted in a similar way between an alignment datum 44 and a flexure 46 and can be fastened using fasteners 50, 52 onto the frame 22. Along the x direction, the two jetting assemblies 18, 20 are pressed tightly against each other toward alignment datums 66, 70 by the flexures 68, 72.

The jetting module 10 is also easy to disassemble and maintain. For example, when one of the jetting assemblies 18, 20 is found to be malfunctioning or is worn or needs to be maintained or replaced, it can be removed by reversing the installation steps and replaced by a jetting assembly of the same type conveniently without use of additional tools or specialized services to reach the original precision and resolution. The function of the remaining jetting assembly and the performance the jetting module 10 are not affected by such a replacement and the cost for maintenance can be kept low.

Figure 3:
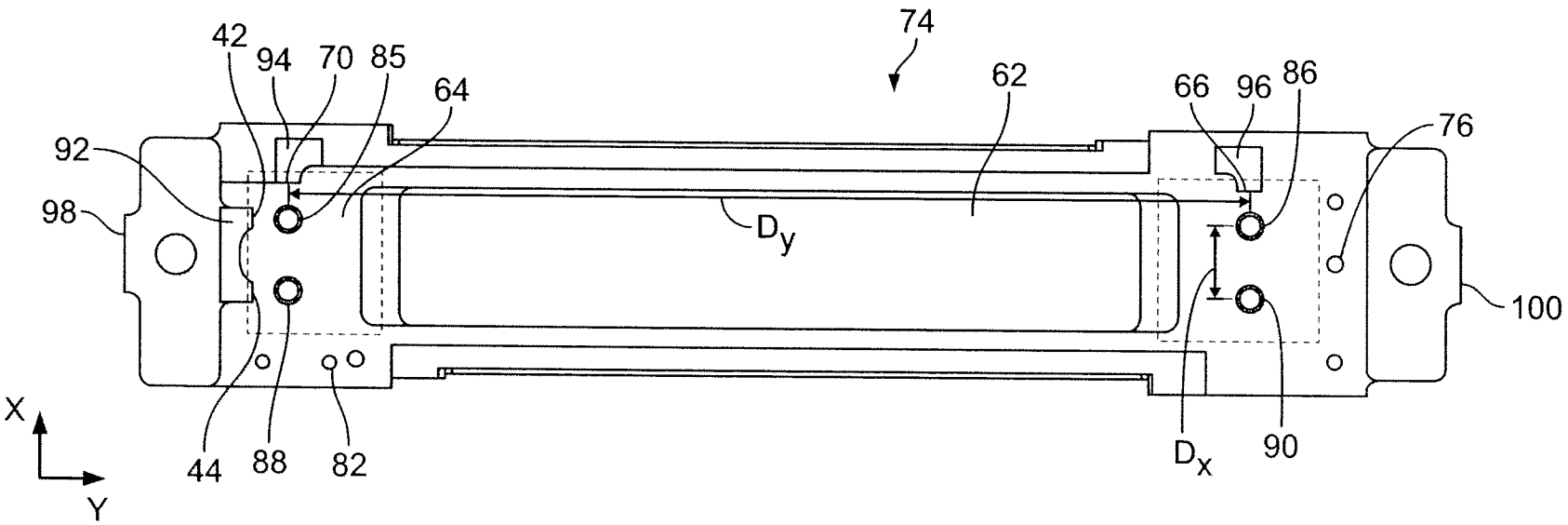
FIG. 3 is a top view of a portion of a module frame.
Figure 4:
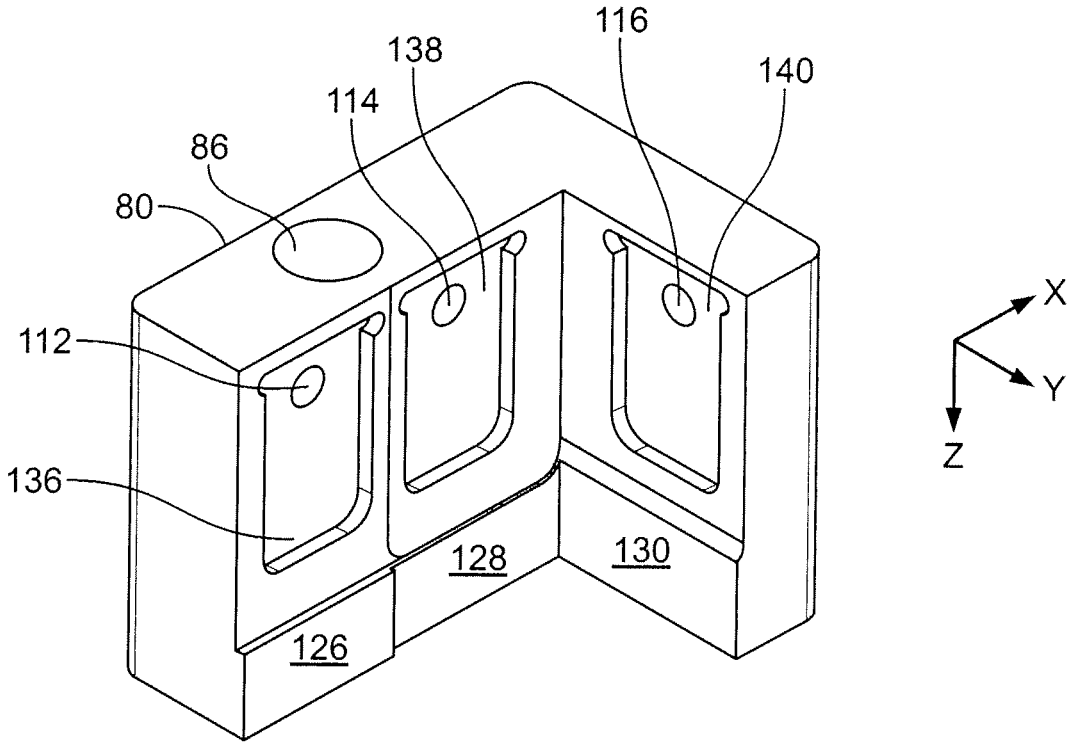
FIGS. 4 and 5 are two perspective views of portions of a module frame.
Figure 5:
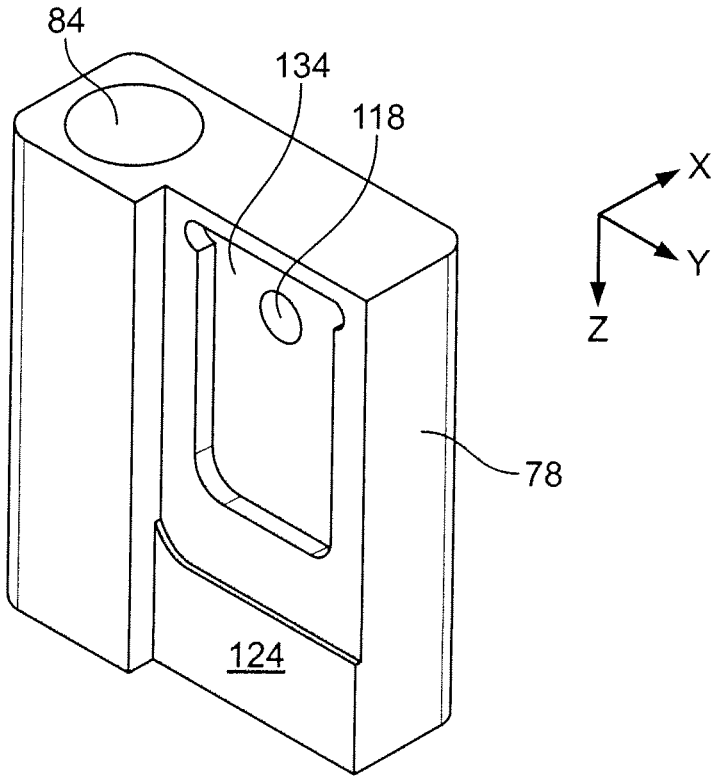

Referring to FIGS. 3, 4, and 5, the frame 22 can be a continuous metallic (e.g., aluminum) piece 74 that is machined to include alignment datums 42, 44, 66, 70. Two flexure supports 78, 80 can be attached to and extend in the z direction from an upper surface 64 of the frame. The flexure support 78 is mounted to the base by a screw (not shown) that passes through a hole 84 and into internal threads (not shown) and a corresponding hole 82 in the frame. Similarly, the flexure support 80 is mounted to the frame 22 by a screw that passes through a hole 86 and into internal threads (not shown) of a hole 76 in the frame. The positions of the flexure supports 78, 80 along the x, y, and z directions relative to the metallic piece 74 are precisely pre-determined based on, for example, the dimensions of the flexure supports 78, 80, the flexures to be attached to the flexure supports, the configurations of the jetting assemblies 18, 20 to be mounted, the positions of the alignment datums 42, 44, 66, 70 and the configuration of the upper surface 64 of the frame, among other things. Generally, the positions of the alignment datums and the flexure supports can be freely selected as long as the positioning of the jetting assemblies 18, 20 described above can be realized.

The alignment datums 42, 44, 66, 70 can be high precision surfaces of mechanical units 92, 94, 96 that extend away from the top surface 64 (see also, FIG. 1). The high precision surfaces can be smooth and have low friction coefficients. For example, each of the surfaces can be machined and polished, and can have a friction coefficient, for example, of less than about 0.5, 0.4, 0.3, 0.25, 0.2, or 0.15, relative to the same material the surface contains or to other materials, such as carbon, aluminum, or anodized aluminum. The smoothness of the high precision surfaces not only makes the alignment of the jetting assemblies on the frame highly precise, but also provides a low drag force on the jetting assembly at interfaces between each alignment surface on the jetting assembly and the corresponding alignment datum on the frame 22 when there are relative movements at the interfaces. Such movements can be caused by, for example, expansion or shrinking of the frame and the jetting assembly upon temperature variations. The alignment datums 66, 70 are precisely aligned along they direction so that when a jetting assembly is pressed against the alignment datums 66, 70 along the x direction, the array of nozzles of the jetting assembly is precisely parallel to they direction.

The alignment datums 42, 44 provide a desired offset distance (for example, d/2 in FIG. 2) along the x direction between corresponding nozzles (e.g., nozzles 36*a*, 38*a*) when the jetting assemblies are mounted on the frame. In the example shown in the figure, the alignment datum 44 extends toward the opening 62 along they direction by an extension distance (not shown) that is substantially equal to the desired offset distance (e.g., d/2) further than the alignment datum 42. The desired offset distance can be, for example, about 20 microns to about 200 microns or about 50 microns to about 150 microns, e.g., 127 microns. The alignment datums 42, 44 are precisely machined such that the difference between the extension distance and the desired offset distance is within ±1 micron, ±2 microns, or ±5 microns. The top surface 64 is substantially smooth and can have a friction coefficient of less than about 0.35, 0.3, 0.25, 0.2, or 0.15, relative to the same material contained in the top surface 64 or other materials such as anodized aluminum contained in the bezel contacting the top surface 64 (e.g., the bezels 58, 60 of FIG. 1). The top surface 64 is also substantially flat within the x-y plane and perpendicular to the jetting direction. The tilting of the surface 64 relative to the x-y plane is less than 0.02 degrees or less in they direction and less than 0.05 degrees in the x direction. The top surface 64 is also a high precision surface for aligning the jetting assemblies along the z direction.

The metallic piece 74 also includes two pairs of holes 85, 86 and 88, 90, each including helical threads (not shown) and having an opening on the surface 64. The two holes in each pair are located on two sides of the opening 62 of the frame and the centers of the two holes align precisely along they direction. The locations of the holes 85, 86, 88, 90 on the metallic piece 74 are precisely pre-determined and manufactured, such that when the jetting assemblies 18, 20 (FIG. 1) are mounted onto the frame 22, a hole in each bezel (e.g., bezel 58, 60) of the jetting assemblies aligns precisely with one of the holes 85, 86, 88, 90 along the z direction. To provide the offset distance discussed previously, like the alignment datums 44, 42, along the y direction, the hole 88 adjacent to the extended alignment datum 44 has its center extended by substantially the desired offset distance further toward the opening 62 than the center of the other hole 85.

The distance between the two holes within each pair along the y direction and the distance between the holes from different pairs along the x direction are precisely pre-determined based on the distance between the holes of the bezels of an individual jetting assembly and its neighboring jetting assembly. The precision can facilitate reducing tensions or other forces within each jetting assembly and/or between the jetting assemblies when the jetting assemblies are fastened to the frame 22. In particular, a distance $D_y$ between the centers of the two holes 85, 86, or 88, 90 along they direction can be substantially equal to a distance $D_b$ between the centers of the two bezels 58, 60 (FIG. 1) of the jetting assembly to be mounted on the frame. For example, $D_y$ can be about 100 mm to 225 mm, depending on the type of the jetting assemblies used. The difference between $D_y$ and $D_b$ can be, for example, within ±30 micron, ±40 microns, or 80 microns, or ±125 microns. A distance $D_x$ between the centers of the two holes 85, 88, or 86, 90 along the x direction is substantially equal to a distance $D_a$ between the centers of the two bezels of the adjacent jetting assemblies. For example, $D_x$ can be about 6 mm, about 8 mm, about 10 mm, or about 12 mm, and the difference between $D_x$ and $D_a$ can be within ±30 micron, ±40 microns, or ±80 microns, or ±125 microns. In some embodiments, the difference between $D_y$ and $D_b$ or $D_x$ and $D_a$ is non-critical (details discussed below).

Figure 6:
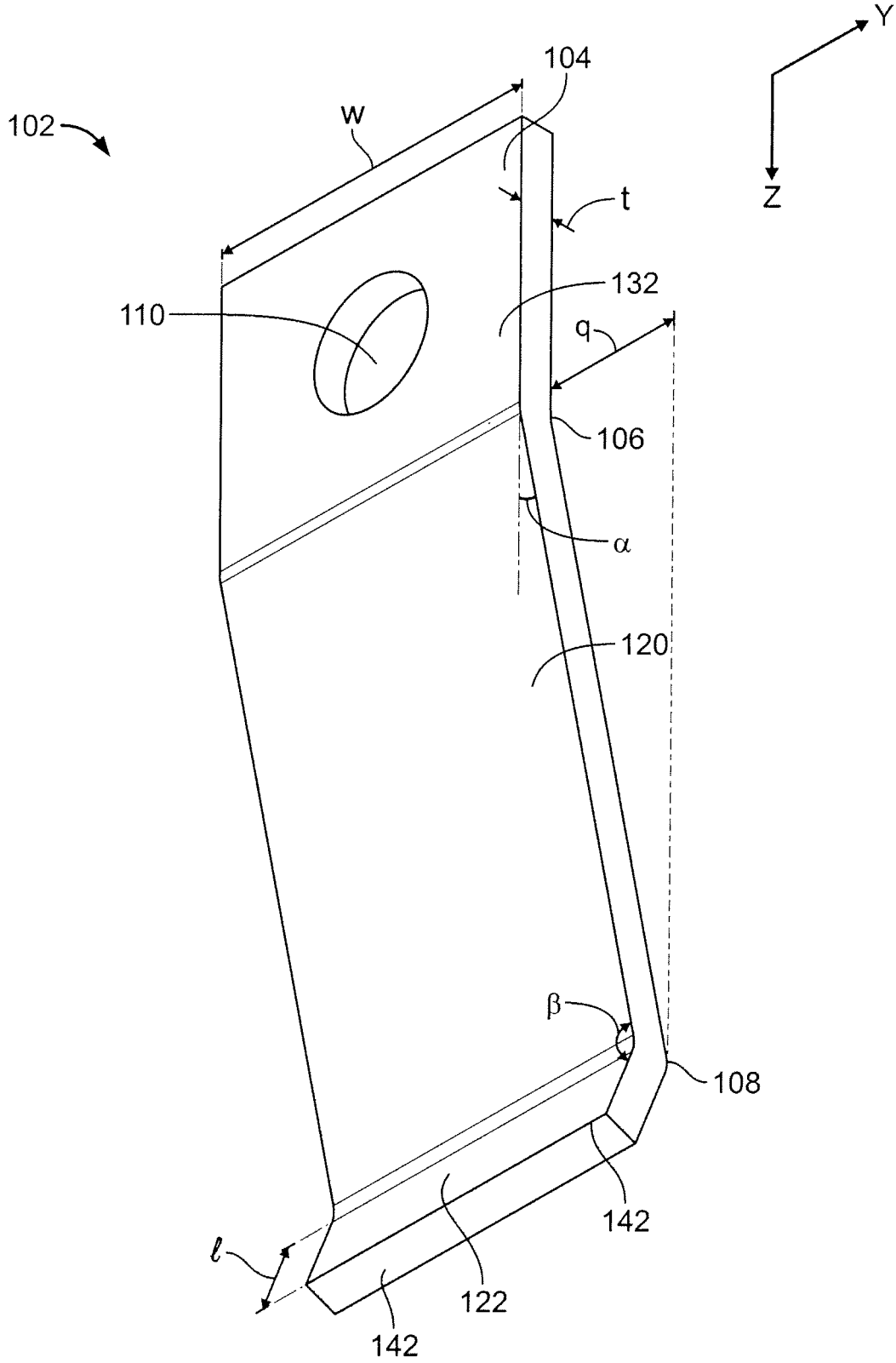
FIG. 6 is a perspective view of a flexure.

Referring to FIG. 6, each flexure 102 to be fastened to the flexure supports 78, 80 (FIGS. 4 and 5) can include a machined metal sheet 104 having a first bending point 106 and a second bending point 108. The metal sheet 104 includes a hole 110 and can be fastened to the flexure supports 78, 80 by, for example, applying a screw into the hole 110 when it is aligned with one of the holes 112, 114, 116, 118 of the supports. When the flexure 102 is fastened to the flexure supports 78, 80 and the metallic piece 74 of the module frame (FIG. 3), a surface 132 of a non-bent portion that contains the hole 110 substantially fully contacts a corresponding setting surface 134, 136, 138, 140 of the flexure supports 78, 80. A bent portion 120 of the metal sheet 104 beyond the first bending point 106 bends by an angle α relative to the surface 132 towards the corresponding alignment datum 42, 44, 66, 70, and a bent portion 122 beyond the second bending point 106 bends by an angle β relative to the bent portion 120 towards a corresponding stopping surface 124, 126, 128, 130 of the flexure supports 78, 80. The ramp shape of the flexure enables the jetting assembly to be conveniently pressed or pulled along the z direction against the second bending point 108 to be positioned onto or removed from the frame 22. The positioned jetting assemblies 18, 20 of FIG. 1 each contacts the second bending point 108 of the flexure 102 with a small contact surface. The contact surface can be smooth and can have a low friction coefficient to provide a small drag force on the jetting assemblies when there are relative movements within the contact surface. The contact surface can have a surface area of about 0.125 to 1.25 square millimeters and the surface area can be polished, e.g., electro-polished. The small drag force between the flexure and the jetting assemblies can allow the jetting assemblies to expand or shrink, for example, when the temperature varies, without disturbing the pumping chambers or nozzles and maintain the precision of the printing done by the jetting module 10 (discussed in detail below).

The first bending point 106 exerts a spring force against the jetting assembly to push the jetting assembly tightly against the alignment datum 42, 44. The spring force is also selected so that when the jetting assembly experiences expansion or shrinking, for example, when the temperature varies, the flexure 102 follows the changes of the jetting assembly while keeping the jetting assembly tightly matched against the corresponding alignment datum. For example, when the jetting assembly is positioned, the spring force against the jetting assembly can be about 5 pounds to about 20 pounds, or about 8 pounds to about 12 pounds. The magnitude of the spring force can be controlled by a spring constant k of the flexure 102, which can be pre-selected by choosing a material, shape, or related parameters, for example, a thickness t, the angles α, and a width w, of the machined metal sheet 104. The spring constant k can be about 200 pounds per inch to about 600 pounds per inch, or about 300 pounds per inch to about 600 pounds per inch, or about 400 pounds per inch to about 500 pounds per inch, for example, 450 pounds per inch. In some examples, the material can be stainless steel, or other suitable metal or plastic materials. The material can also be coated with one or more coatings to provide desired smoothness or other electrical, thermal, and/or mechanical properties. The various parameters such as α are chosen such that a distance q between the surface 132 and the second bending point 108 along the second bending point 108 along the y direction is about 2.0 mm, 2.5 mm, 3.0 mm, 3.043 mm, 3.1 mm, 3.2 mm, 3.293 mm, 3.3 mm, and/or up to about 3.5 mm, 3.45 mm, or 3.40 mm. The angle α can be, for example, about 5 degrees, 8 degrees, 10 degrees, 13 degrees, 13.7 degrees, 15 degrees, and/or up to about 25 degrees, 22 degrees, 20 degrees or other degrees. The width w can be, for example, about 3 mm to about 10 mm, e.g., 6 mm, or other width The thickness t can be, for example, about 0.4 mm to about 1.0 mm or about 0.5 mm to about 0.8 mm, e.g., 0.64 mm, or other thickness.

The flexure 102 includes an inherent working condition so that the flexure does not wear out and lose its spring feature. For example, under the working condition, the angle α is compressed so that the second bending point 108 and/or a front edge 142 of the bent portion 122 each travels toward the flexure supports 78, 80 by less than about 600 microns, 550 microns, 500 microns, 475 microns, or 450 microns along they direction. Compression of the angle α beyond the compression range is prevented using the design of the bent portion 122 and the stop surfaces 124, 126, 128, 130 of the flexure supports 78, 80 (FIGS. 4 and 5). In particular, the length l of the bent portion 122, the angle β, and other related parameters are selected so that when needed, the front edge 142 of the bent portion 122 is stopped by the stop surface 124, 126, 128, 130 to prevent the further compression of the angle α. The angle β can be about 60 degrees, 70 degrees, 80 degrees, 90 degrees, 100 degrees, and/or up to about 175 degrees, 165 degrees, 155 degrees, 145 degrees, 145.7 degrees, or 130 degrees. In some embodiments, prior to the loading of the jetting assemblies 18, 20 (FIG. 1), in an assembled frame 22, a distance between the front edge 142 of the bent portion 122 and the stop surface 124, 126, 128, 130 is, for example, about 600 microns, 650 microns, 700 microns, 750 microns, 762 microns, 800 microns, and/or up to about 1000 microns, 950 microns, or 900 microns. The metal piece 74 of the frame 22 can also include additional alignment datums 98, 100 for precisely positioning the jetting module 10 onto the printbar 12.

The precise positioning of the jetting assemblies 18, 20 on the frame 22 (FIG. 1) is also facilitated by the high precision alignment datums on the jetting assemblies that match or engage with the alignment datums carried by the frame 22. FIG. 7 shows a portion 146 of a jetting assembly that includes a base 144 that includes the ink inlet 28 and a bezel 58 (see also, FIG. 1). The portion 146 of FIG. 7 is attached, e.g., screwed or glued, to a body (not labeled) that includes the pumping chambers 24 of the jetting assembly on each side of the body. The bezel 58 and the base 144 can be machined as an integrated piece having a desired configuration for attaching to jetting assemblies of different types. In some implementations, the bezel 58 can be designed or manufactured uniformly and can be fastened to bases, like the base 144, having different configurations and sizes for different types of jetting assemblies. With the assistance of the portion 146, different jetting assemblies known in the art can be readily used in the jetting module 10 (FIG. 1) without modification of the body.

Referring to FIG. 8, in the jetting module 10 of FIG. 1, two identical portions 146*a*, 146*b* each being the same as the portion 146 of FIG. 7 and attached to one of the adjacently positioned jetting assemblies 18, 20 are in contact with each other through the surfaces of the bezels. Each bezel 58*a*, 58*b* can include three alignment datums 148, 150, 152 in the form, for example, of high precision surfaces. The alignment datum 148 along they direction can contact the alignment datum 42, 44 (FIG. 1), or the second bending point 108 of the flexure 102 (FIG. 6). Along the x direction, each bezel 58*a*, 58*b* has a width D that is larger than a width of any other portion of the jetting assembly such that the two jetting assemblies contact with each other only at the high precision surfaces of the bezels 58*a*, 58*b*. In the example shown in the figure, the high precision surface 152 of the bezel 58*a* engages with the high precision surface 150 of the bezel 58*b*. The two high precision surfaces 152, 150 of the two bezels 58*a*, 58*b* are pressed tightly against each other between the alignment datum 58 and the flexure 72 or the alignment datum 66 and the flexure 68 (FIG. 1). The high precision surfaces 150, 148, 152 can have the same features, for example, dimensions or low friction coefficients, as the high precision surfaces 42, 44, 66, 70 of FIG. 3 and function similarly. For example, the surface area of each high precision surface 150, 148, 152 is about 4 $mm^2$ to about 10 $mm^2$, e.g., about 5 $mm^2$ and the surface area of each precision surface 42, 44, 66, 70 is about 4 $mm^2$ to about 10 $mm^2$, e.g., about 5 $mm^2$. The surface areas of these high precision surfaces are sufficiently large for the engagement of the surface and at the same time sufficiently small for reducing drag forces on the engaged surfaces when relative movements between the engaged surfaces occur. The bottom surface 153 (not fully visible) of the bezel 58*a* or 58*b* can also be a high precision surface with low friction coefficient so that when it is in contact with the top surface 64 of the frame 22, the nozzle arrays of the jetting assemblies are substantially within the same, horizontal x-y plane.

Referring to FIG. 10, the fasteners 50, 52, 54, 56 of FIG. 1 can each include a spring 156 and a ring 158 assembled on a shoulder screw 154. The spring 156 winds around the middle body 169 of the screw 154 between the ring 158 and the head 165, and is held captive between the head 165 and the ring 158. In use, a distal end 160 of the shoulder screw 154 can be screwed into the holes 85, 86, 88, 90 of the metal piece 74 (FIG. 3) and the spring 156 can compress through the ring 158 the bezel 58 tightly against the surface 64 of the metal piece 74 (FIG. 3). The distal end 160 carries helical threads 163 that corresponds to the helical threads in the holes 85, 86, 88, 90 of the metal piece 74 (FIG. 3). The distal end 160 can have a length h which is less than the depth of the holes 85, 86, 88, 90. When the distal end 160 is fully inserted in the holes of the frame 22, the shoulder 167 of the shoulder screw 154 contacts the top surface 64 of the frame 22. Such a contact acts as a stop so that the spring 156 is compressed by a predetermined amount. Because of the stop, the amount of torque used to seat the shoulder screw does not affect the amount of compression on the spring. In some embodiments, the torque used to seat the screw can be from about 0.5 inch pounds to about 20 inch pounds.

The middle body 169 of the screw 154 can have a diameter $d_m$ smaller than the diameter $d_b$ of the hole 168 and can pass through a hole 168 of the bezel (FIG. 8) without contacting the bezel so that the screw body is thermally insulated from the bezel. For example, the diameter $d_m$ can be about 3 mm to about 8 mm or about 4 mm to about 6 mm and the diameter $d_b$ can be about 3.5 mm to about 8.5 mm or about 4 mm to about 6.5 mm. In addition, the room between the screw body the bezel allows the bezel to expand or shrink, e.g., when the temperature changes, within the x-y plane without the screw's interference. The difference between the diameter $d_m$ and the diameter $d_b$ can be large, for example, up to about 1000 microns, 750 microns, or 500 microns and such a difference also allows the difference between $D_y$ and $D_b$ or $D_x$ and $D_a$ (FIG. 3) to be relatively large so that machining of the these relative distances $D_y$, $D_b$, $D_x$, and $D_a$ does not have to be done with a super-high precision.

The spring 156 exerts a force of about 2 pounds to about 10 pounds or about 4 pounds to about 8 pounds, e.g., 5 pounds, through the ring 158 onto the bezel 58. The bezel 58 is clamped between the spring and the frame. The use of the fastener 154 creates no torque between the bezel 58 and the surface 64 within the x-y plane and generates no influence on the previously precisely positioned jetting assemblies within the x-y plane. The spring 156 also allows the bezel to expand or shrink along the z direction when the temperature changes. The ring 60 can be made of a thermally and electrically non-conductive material so that the bezel (and therefore, the jetting assembly) is thermally and electrically insulated from the shoulder screw 154 and the spring 156. The shoulder screw 154 and the spring 156 can be made of a metallic material, for example, stainless steel or others. The ring 60 can be made of, for example, a plastic, a rubber, or a homopolymer acetal (e.g., Delrin available from Professional Plastics, Inc. at CA, USA) One or more coatings can be applied to these elements, for example, to change the mechanical, chemical, or electrical properties of the elements.

The frame 22 (FIG. 1), which includes the metallic piece 74 and the flexure supports 78, 80 (FIGS. 3-5), and the portion 146 (FIG. 7) of each jetting assembly can include a same structural material to provide a uniform thermal and electrical conductivity throughout the frame 22 and the portion 146. The uniform thermal or electrical conductivity can allow the jetting assembly and the frame to be capable of reacting to thermal or electrical variations in the module or in the environment in a substantially similar way. For example, the jetting assemblies 18, 20 and the frame 22 can expand or shrink by a similar amount (e.g., the difference being less than about 200 microns or less than about 100 microns, e.g., about 65 microns to about 75 microns) in different directions when the temperature of the jetting module 10 varies (e.g., by about 20° C. to about 80° C.). The uniform conductivity can allow charges, for example, static charges, accumulated during printing on different parts of the jetting module 10 to be eliminated through the grounded frame 22. Suitable structural materials can include, for example, aluminum, in particular, cast aluminum tooling plate (e.g., MIC-6 available from Radwell International at Lumberton, N.J.). The cast aluminum tooling plate can be resistant to twisting or warping during machining or thermal cycling.

In some implementations, one or more additional thermally and electrically conductive, and chemically and mechanically resistant coatings can be formed on the entire surface of the frame 22, including surfaces of the flexure supports 78, 80, or selected surfaces, for example, the high precision surfaces, of the frame 22. The coating is thermally and electrically conductive so that the desired thermal and electrical properties of the structural materials of the frame and the portion 146 are maintained. The chemical resistance of the coating can prevent the frame 22 and the portion 146 from chemically reacting with each other or with ink that is spilled or leaked onto the external surfaces of the jetting module 10 and facilitate maintaining the precision of the alignment datums on the frame. The high mechanical resistance of the coating prevents wearing of the alignment datums and other surfaces. For example, the surfaces of the alignment datums or the flexures can be prevented from being mechanically removed or changed by the friction caused by the contact and movements (e.g., during assembling) of the surfaces of the jetting assemblies.

Suitable coating materials can include, for example, aluminum nitride, chromium, nickel, Teflon-nickel, or their combinations. In some embodiments, the coating material includes a homogeneous Teflon-nickel mixture that contains, for example, about 20 wt % to about 30 wt % or about 22 wt % to about 24 wt % of polytetrafluoroethylene (PTFE). The coating can have a thickness of about 2 μm, 4 μm, 5 μm, 8 μm, 10 μm, and/or up to about 20 μm, 18 μm, 15 μm, 13 μm, 12 μm. One commercially known Teflon-nickel coating material is NICKLON available from Bales Mold Service at Downers Grove, Ill. Similar coating materials such as TEFNI-2000 available from Westfield Electroplating at Westfield, Mass. In some embodiments, the coating material includes a nodular, thin, and dense chromium, which can be electroplated onto desired surfaces and can have a thickness of about 1 micron to about 10 microns, for example, about 2.5 microns, 5 microns, 5.5 microns, 7 microns, or 7.5 microns. A commercially known technique of such a chromium coating is available from the Armoloy® Corporation, Dekalb, Ill. In some embodiments, multiple coating materials and processes can be used. For example, a duplex nickel/Armoloy plating process can be used.

In some embodiments, the surfaces of the alignment datums on the jetting assembly are coated with one or more chemical-resistant, e.g., ink-resistant, coatings to chemically protect the surfaces and maintain the high precisions of these surfaces. For example, the surfaces 148, 150, 152 of FIG. 8 are coated with a release agent, for example, a mold release agent SK22 (available at Stoner Inc., Quarryville, Pa.). In some implementations, the surface of the alignment datums on the jetting assembly can be anodized (for example, anodize per MIL-A-8625F Type A, Class 2, Black). The chemical-resistant coatings can be optionally applied onto the anodized surfaces.

In the example shown in FIG. 9, the alignment datums on the portion 146 of a jetting assembly can include a chemical-resistant protrusion unit 154 attached, e.g., glued, onto each surface 148, 150, 152 (see also, FIG. 8). The protrusion 154 can partially or entirely cover the surface onto which it is attached and can have a precision surface that contacts the corresponding alignment datums or flexures on the frame 22 in replacement of the surfaces 148, 150, 152. These protrusion units 154 separate the originally contacting surfaces of the alignment datums to prevent the contacting surfaces from chemical reactions in presence of ink. The protrusion unit 154 can be made of a material with good thermal conductivity, for example, graphite, e.g., DFP carbon (available from Poco Graphite, Inc., at Decatur, Tex.), or ACF-10Q (available from Poco Graphite, Inc., at Decatur, Tex.), so that the thermal conductivity of the entire jetting module 10 (FIG. 1) is not affected. The jetting assemblies are kept in electrical contact with the frame 22 through the contact of the bezels and the top surface 64 of the frame (FIGS. 1 and 3).

Referring back to FIG. 1, a heating element 156 is attached to a surface of the frame 22 to heat the ink within the pumping chambers of the jetting assembly 20 to reduce the ink viscosity and facilitate ink jetting. Another heating element (not shown) can be similarly placed and used for the jetting assembly 18. The heating element 156 extends along they direction to cover the row of pumping chambers 24 and can heat the frame to about 30° C. to about 65° C. Examples of the heating element 156 can include a 60 watt strip heater.

The heating of the frame 22 can cause the frame 22 and the jetting assemblies 18, to expand along all three directions. For example, heating the frame 22 from a room temperature (about 7° C. to about 32° C.) to about 80° C. or 60° C., the frame 22 and each jetting assembly expand naturally by about 30-40 microns along they direction. The term "naturally" as used herein, means that the amount of expansion or shrinking is measured as if the frame 22 or the jetting assemblies 18, 20 were free-standing and were not positioned or confined (e.g., by the printbar 12 or the frame 22, respectively). In some embodiments, the jetting assembly and the frame 22 may naturally expand by a different distance along one or more of the directions. For example, the difference can be about ±50 microns to about ±200 microns or about ±65 microns to about ±100 microns. It is desirable for the jetting assemblies to expand or shrink freely by the distance they naturally would have under the environmental conditions without the confinement of the frame 22. The natural shapes of the pumping chambers, nozzle arrays, and other parts of the jetting assemblies as machined or made can be preserved during the natural expansion of the jetting assemblies so that, for example, the nozzles in the nozzle arrays are kept equally distanced and the high precisions of the relative alignments of the jetting assemblies are maintained.

The free-expansion or shrinking of the jetting assemblies by their natural amount independent of the frame is realized by the design of the jetting module 10 discussed previously and the jetting module 10 is capable of printing at a desired resolution with a high precision throughout the printing process. The jetting module 10 can absorb the difference between the expansion of the frame and the jetting assembly up to about 300 microns, 275 microns, or 250 microns while keeping the precisions of the alignments and positioning of the jetting assemblies. FIG. 11 schematically shows the top view of the frame 22 (some parts are not shown) described in FIGS. 1 and 3-6. In each of the x and y directions, one alignment datum that includes a hard stop pairs with a corresponding flexure structure (e.g., the alignment datum 42 and the flexure 48, the alignment datum 44 and the flexure 46, the alignment datum 70 and the flexure 72, and the alignment datum 66 and the flexure 68). The jetting assemblies 18, 20 can be loaded between the alignment datum-flexure pair such that each has one end engaged with the hard stop of an alignment datum and the other corresponding end loaded by the corresponding flexure. Along the z direction, the jetting assemblies 18, 20 each is positioned between the high precision surface 64 serving as a hard stop when the fastener (e.g., the fastener 54) is screwed into the frame 22 and the spring 156 (FIG. 10). Accordingly, in each direction, the jetting assemblies 18, 20 are capable of expanding or shrinking relative to the frame 22 at the ends that are in contact with the flexures or the spring. The difference between the natural expansion or shrinking of the jetting assemblies and the frame is small because of the material used and uniform thermal conductivity within the jetting module 10 and can be tolerated by the flexures and the spring. In addition, drag forces within all surfaces with which the jetting assemblies contact with each other or with the frame are small so that the jetting assemblies can be substantially free to expand or shrink without substantial drags. For example, when expanding or shrinking along the x or y direction, the total drag forces on each jetting assembly is less than 20 pounds, less than 18 pounds, less than 15 pounds, less than 12 pounds, less than 10 pounds, less than 8 pounds, or less than 6 pounds.

In the example shown in FIGS. 12, 13, and 14, along they direction, a pumping chamber array 158 including pumping chambers 24 is precisely positioned on a frame 22 (FIG. 1) between a hard stop and a flexure. Each neighboring pair of pumping chambers 24 is equally apart by a distance $d_c$. When the environmental temperature changes, for example, by heating the frame 22 as explained above, the pumping chamber array 158 expands and pushes the flexure back by a distance $d_e$ that is substantially equal to a difference between the natural expansion distances of the pumping chamber array 158 and the frame 22. The pumping chambers 24 remain equally-spaced with a neighboring distance larger than $d_c$. A second pumping chamber array of the other jetting assembly on the frame 22 can undergo the same expansion and the precise offsets of the pumping chambers from the two jetting assemblies along the x direction as described in FIG. 2 are maintained. In contrast, if the pumping chamber array 156 had been fixed between two hard stops or the fasteners 50, 52, 54, 56 had prevented the array from expanding, upon heating, the array 160 would form an arc shape (if the frame expands less than the array), causing the neighboring distances $d_1$, $d_2$, $d_3$ to be different from each other. The pumping chamber array 160 would then print printlines that are not equally-spaced and the precisions of the pre-determined offsets of the pumping chambers 161 relative to those of the other jetting assembly on the same frame along the x direction are lost.

Although in the example shown in FIG. 1, only two jetting assemblies are positioned within the frame 22, three or more jetting assemblies can be positioned in a similar manner to that of the jetting assemblies 18, 20 onto a frame that is designed similar to the frame 22 to provide the capability of printing at an even higher resolution than the module 10. For example, such a frame can include an opening larger than the opening 62 (FIG. 3) and suitable for exposing three rows of nozzles from three or more jetting assemblies stacked along the x direction. One or more additional sets of flexure and alignment datum can be arranged next to the flexure 46 and alignment datum 44 to receive the additional jetting assembly. The alignment datums 42, 44, and the additional alignment datum can provide an offset of about d/n for each nozzle relative to a corresponding nozzle of a neighboring jetting assembly, where n is an integer that represents the total number of jetting assemblies.

In some embodiments, a frame 162 (FIG. 15, details not shown) can allow precise positioning of four identical jetting assemblies 164, 166, 168, 170 to provide a capability of printing at a resolution twice as high as the resolution at which each jetting assembly is capable of printing, and an print width S of about 1.5 to 2 times as large as a the printing range (e.g., R of FIG. 2) of a single jetting assembly (the jetting assemblies can be in contact with each other and/or with the frame 162, which is not shown in the figure). For example, the width S can be about 60 mm to about 130 mm, e.g., 64.5 mm, or about 130 mm to about 260 mm. The frame 162 has a zigzag shape including a first half portion 172 and a second half portion 174, each for positioning of two jetting assemblies. Each half portion 172, 174 can be similar (e.g., including alignment datums and flexures) to the frame 22 of FIG. 1 to allow a easy positioning of the two jetting assemblies 164, 166 or 168, 170 to provide the capability of printing at a resolution twice as large as a resolution at which each jetting assembly is capable of printing. The jetting assemblies in the first half portion 172 each has its nozzles aligned along the x direction with the nozzles of a corresponding jetting assembly in the second half portion 174. In the example shown in FIG. 15, nozzles 176*a*, 176*b* of the jetting assembly 164 align with nozzles 178*a*, 178*b* of the jetting assembly 168, and nozzles 180*a*, 180*b* of the jetting assembly 166 align with nozzles 182*a*, 182*b* of the jetting assembly 170. The overlapping distance p, and therefore, the number of the aligned nozzles along the x direction can be selected as desired and can be controlled by the shape and alignment datums of the frame 162. For example, the overlapping distance p can be, for example, about 0 mm to about 5 mm. Additional alignment datums, flexures, springs, and/or fasteners similar to those discussed previously can be used to facilitate the positioning and the alignment of the jetting assemblies in different portions of the frame 162. In some embodiments, each half portion 172, 174 of the frame 162 is designed for positioning of three or more jetting assemblies. The two half portions 172, 174 can receive the same or a different number of assemblies. In addition, the frame can be extended to have a stair shape and include three or more portions, each being similar to the half portions 172, 174. The stair-shaped frame can provide a larger printing width. Other shaped, for example, pyramid-shaped (FIG. 17 below), frame can also be used.

Referring back to FIG. 1, similar to the positioning of the jetting assemblies in the jetting module 10, the jetting module 10 can be positioned on the printbar 12 with one of the two alignment datums 98, 100 engaged with a hard stop on the print bar 12 and the other one of the two alignment datums 98, 100 spring loaded, for example, with a flexure or a spring. The frame 22 of the jetting module 10 can expand or shrink naturally on the printbar 12 when needed. For example, the alignment datum 100 can be spring loaded with a loading force of about 10 pounds to about 50 pounds, for example, 12 pounds, along they direction. The alignment datum 98 can engage with a hard stop that provides a force of about 50 N to about 100, for example 80 N. The positioning of the jetting module 10 along the other directions can be done similarly or differently. For example, along the x and z directions, the jetting module 10 can be spring loaded with a loading force of about 2-10 pounds, e.g., 5 pounds, and about 20 pounds, 15 pounds, 10 pounds, or 5 pounds, respectively. The loading of the jetting module can also allow the jetting module to expand or shrink up to an amount of about 300 microns, 275 microns, or 250 microns.

In some embodiments, the printbar 12 can be designed such that the precise positioning of multiple jetting modules 10 of FIG. 1 on the printbar 12 enables the printer to print at an even higher resolution, or a larger print width along they direction, than each jetting module 10 is capable of printing. For example, two or more jetting modules 10 can be positioned on the printbar in a manner similar to the way in which the two jetting assemblies 18, 20 are positioned on the frame 22. The corresponding nozzles of different jetting modules can offset relative to each other to provide a high nozzle density along the rows of the nozzles. The two jetting assemblies in each jetting module 10 can print with the same color or with two different colors. In some embodiments, the multiple jetting modules 10 positioned on the printbar 12 can print with more than two colors.

The printbar 12 can include pre-determined alignment datums and their corresponding springs or flexures similar to alignment datums 42, 44 to enable each jetting module 10 to be precisely positioned onto the printbar 12. The printbar 12 can also include adjustable alignment datums, for example, screw adjustable, and can be used to receive jetting modules of different sizes and types. High precision can be reached by test printing and fine tuning of the adjustable alignment datums. The printbar 12 can contain the same material as the base material of the frame 22, for example, aluminum, stainless steel, or plated steel. Other materials can also be used.

In the example shown in FIG. 16, the printbar 12 can have a set of openings 190, 192, 194 arranged in a pyramid arrangement. Each opening in the set includes a predetermined alignment datum 196 and a corresponding flexure or spring 198 to load a jetting module 10. Each alignment datum and flexure can be similar to or the same as those discussed above. Other arrangement of the datums and the flexures in the set of openings are possible. More alignment datums and flexures or springs can be used and each loaded jetting module 10 can expand or shrink relative to the printbar 12 in a manner similar to the way each jetting assembly 18, 20 expands or shrinks relative the frame 22. The opening 194 at the top of the pyramid had each of its two ends overlap with each opening 190, 192 along the x direction. The jetting modules 10 positioned in these openings can overlap in overlapping ranges 200, 202 so that the nozzles from the jetting modules 10 loaded in the bottom openings 190, 192 are aligned with nozzles from the jetting module 10 loaded in the top opening 194 along the x direction within the overlapping ranges 200, 202. A printing width 204 of the three loaded jetting modules 10 can be about three times as large as a printing width of an individual jetting module and within the printing width 204, the nozzles from all three jetting modules 10 can be equally spaced along the row of the nozzles (y direction). The overlapping ranges 200, 202 can be selected based on the dimensions of the jetting modules 10, the number of nozzles to be overlapped along the x direction, and other parameters or conditions. The printbar 12 can include two or more sets of openings like the set of openings 190, 192, 194 along the x direction to increase the overall nozzle density along the y direction, or along they direction to obtain an even larger printing width 204.

In the example shown in FIG. 17, the printbar 12 can include one or more openings 206 each being capable of receiving three jetting modules 10. Each opening 206 corresponds to the set of openings 190, 192, 194 of FIG. 16. In particular, the opening 206 includes three portions 190*a*, 192*a*, 194*a* arranged in a pyramid arrangement. The top portion 194*a* is connected to the bottom portions 190*a*, 192*a* in the opening areas 200*a*, 202*a*. Each portion of the opening 206 can include features, e.g., alignment datums and flexures or springs (not shown), similar to those of each opening of FIG. 16. The jetting modules 10 can be loaded into the opening 206 in a manner similar to the way they are loaded into the set of openings of FIG. 15 and can have features, for example, an expanded printing width, similar to those of the jetting modules 10 of FIG. 16. Each jetting module 10 can include one or more additional alignment datums such that each jetting module 10 loaded in the bottom portion 190*a*, 192*a* registers with the jetting module 10 loaded in the top portion 194*a* directly through the alignment datums in the open areas 200*a*, 202*a*. The printbar 12 can also include other shaped openings. In some embodiments, each opening or opening portion of FIGS. 16 and 17 can load two or more jetting modules.

In a particular example shown in FIGS. 18 and 19, a print bar 220 includes four parallel openings 222*a*-222*d* defined in a base plate 223 and separated from each other by separation bars 244. Each opening is sized for positioning one jetting module, for example, the jetting module 10 of FIG. 1, and exposing the nozzles of the jetting module 10 for printing. For illustration purposes, one frame 22*a* (like the frame 22 of FIG. 1) is shown in the opening 222*d* (without the jetting assemblies, e.g., jetting assemblies 18, 20, being shown). Along they direction (parallel to the direction along which each separation bar 244 extends), the frame 22*a* is tightly fitted between a spring plunger 228 at the opposite side 226 of the printbar 220 and an adjustment screw 230 at the operating side 224 of the printbar 220. In particular, the frame 22*a* has one end 260 carrying the alignment datum 100 spring loaded against the spring plunger 228. The spring plunger 228 can have a curved, e.g., ball-shaped, contact head 232 extending from a main body 229 and in point contact with the alignment datum 100. The contact head 232 can exert on the alignment datum a spring force determined by a spring constant of the spring plunger 228 and a predetermined linear displacement of the contact head 232 when the frame is inserted. Each spring plunger 228 can have a spring constant of about 10 N/m to about 50 N/m and can exert a force of about 25 N to about 100 N on the frame 22*a*.

In the same direction, the frame 22*a* has another end 262 carrying the alignment datum 98 in contact with a hard stop provided by a head 234 of the adjustment screw 230. The head 234 can also have a curved surface to provide only a point contact between the adjustment screw 230 and the alignment datum 98. The adjustment screw 230 can move back and forth along the y direction by turning the screw. The spring loaded alignment datum 100 can move against the spring force exerted by the contact head 232 of the spring plunger 228 and the location of the frame 22*a* along they direction relative to the printbar 220 can be adjusted. In some embodiments, the adjustment screw 230 can move by a distance of about 0 microns to about 1000 microns along the y direction, and the movement can be as precise as about 1 micron to about 15 microns.

Along the x direction, the frame 22*a* is positioned between a first pair of a flexure 236*a* and a corresponding hard stop 238*a* and a second pair of a flexure 236*b* and a corresponding surface 239 of a tapered cone 252. In some examples, the two flexures 236*a*, 236*b* can be identical and diagonally arranged relative to each opening 222*a*-222*d*. Each flexure 236*a*, 236*b* can include a fastened end and a free end extending from the fastening end. Each free end carries an alignment datum 240*a*, 240*b* exerting a force on a side surface 241*a*, 241*b* (FIG. 19) of the frame 22*a*. Each force is in an opposite direction to a force exerted by the corresponding hard stop 238*a* and the surface 239 of the tapered cone 252. When the flexures are diagonally arranged, a straight line connecting the alignment datums 240*a*, 240*b* is not parallel to the x direction and the extensions of the directions of the forces exerted by the hard stops 238*a* and the surface 239 on the frame 22*a* do not overlap. At the fastened end, the flexures 236*a*, 236*b* can be attached to edges 246, 248 of the printbar 220 and the separation bars 244 using, for example, one or more del pins 242 (not all shown) and screws 250. The hard stops 238*a* can be a continuous portion of the ends 246, 248 and the separation bars 244, and can have a flat or curved high precision surface to contact an external surface on each side of the frame 22*a* in the x direction.

An edge point 245 of the frame 22*a* contacts a contact point 243 on the cone surface 239. The edge point 245 can be pressed up and down along the x direction when the contact point 243 moves on the cone surface 239. In the example shown in the figure, the cone 252 tapers in from the end of the opening 222*d* toward the center of the opening 222*d* continuously. The large-diameter end 253 is connected to an adjustable screw 254 and the small-diameter end 255 rests on a guide 238*b* so that when the screw 254 turns, the small-diameter end 255 (and the entire cone 252) moves linearly back and forth along they direction on the guide 238*b*. In particular, when the cone 252 is adjusted to move in towards the guide 238*b*, the contact point 243 moves to a spot on the surface 239 that corresponds to a large diameter and presses the edge point 245 towards the flexure 236*b*. On the other hand, when the cone 252 is adjusted to move out towards the operation side 224, the contact point 243 moves to a spot on the surface 239 that corresponds to a small diameter and releases the edge point 245 back towards the cone 252. The edge point 245 of the frame 22*a* can move along the x direction by a distance value of about 0 microns to about 500 microns, and the movement can be as precise as about 1 micron to about 10 microns. The surface 239 of the cone 252 is smooth and is made with a high precision to facilitate the high precision adjustment of the edge point 245 of the frame. The tapering angle 257 of the tapered cone 252, the density of the threads 259 of the screw 254, the total tunable distance (not shown) of the screw 254, and other parameters can be selected to obtain a desired precision and total distance the edge point 245 is capable of moving.

The movement of the edge point 234 of the frame 22*a* adjusts the orientation of the frame 22*a* within the x-y plane. The orientation can be characterized by an orientation angle θ (exaggerated for demonstration) between a long axis 256 of the frame 22*a* and the y direction in the x-y plane. For example, when the edge point 245 is pushed to move towards the flexure 236*b* along the −x direction, the frame 22*a* pushes against the alignment datum 240*b* of the flexure 236*b* so that the alignment datum 240*b* retreats back towards the end 246 of the printbar 220 along the −x direction. At the same time, the hard stop 238*a* pushes the frame 22*a* against the alignment datum 240*a* of the flexure 236*a* so that the frame 22*a* rotates clockwise and the angle θ increases. By reversing the direction of the movement of the edge point 245, the frame 22*a* can rotate anti-clockwise and angle θ can decrease. The diagonal arrangement of the flexures 236*a*, 236*b* and the point contacts between the frame 22*a* and the surface 239, the adjustment screws 252, 254 and other components of the printbar 220 facilitate the movement of the frame 22*a* and the adjustment of the angle θ. In some implementations, each flexure 236*a*, 236*b* has a spring constant of about 20 N/m to about 60 N/m and exerts a force of about 10 N to about 100 N on the frame 22*a*. The angle θ can be adjusted by a value up to about ±0.4 degrees and the precision of the adjustment can be about 0.01 degrees to about 0.05 degrees. In some embodiments, the cone 252 can taper in in a direction opposite to the direction (−y) shown in the figure. Other suitable devices with a tapered surface can also be used.

Each jetting module 10 or frame 22*a* positioned in one of the four openings 222*a*-222*d* can be adjusted for precise alignment with other jetting modules or frames positioned in the other openings without affecting the positions and orientations θ of the other jetting modules or frames. The adjustment of the position can be independent of the adjustment of the orientation of each jetting module 10 or frame 22*a*. For example, after the position and the orientation of the first frame 22 in the opening 222*d* are adjusted and set, the tapered cone 252 corresponding to the opening 222*c* can be adjusted to align a long axis of a second frame in the opening 222*c* to the long axis 256 of the first frame 22*a*. The relative positions of the nozzles of the first and second frames along the x direction can then be adjusted by turning the adjustment screws 230 of the opening 222*c* (y-direction pixel adjustment) without affecting the previously aligned orientations of the frames. The additional two frames in the openings 222*b*, 222*a* can be similarly aligned. The amount to be adjusted for θ and for the y-direction pixel can be determined by test printing or by optical measurements. The y-direction pixel adjustment can make the nozzles of each jetting module 10 align or offset with respect to each other along the x direction, depending on different printing needs. The alignment adjustment can be operated and completed by accessing only the operating side 224 of the frame and can be conveniently done by users without special tools.

After the adjustments for all four jetting modules 10 are done, the adjustment screws 230 and the tapered cones 252 with the screws 254 can be fixed relative to the base plate 223 and the separation bars 244.

Once the jetting modules are set, if one or more jetting modules 10 needs to be replaced or removed and reinstalled, this can be done quickly and easily by pulling out the one or more jetting modules 10 and inserting new (or reinstalled) jetting modules 10 between the flexures, spring plungers, hard stops, and the fixed adjustment screws 230 and tapered cones 252, without repeating the procedures of aligning the new jetting modules 10. The replacement of one or more jetting assemblies in the jetting modules 10 can be done directly in the jetting module 10 without affecting the positioning of the jetting modules 10 in the printbar 220.

As shown in FIG. 18, the frame 22*a* can be fastened to the printbar 220 by pressing the two ends 260, 262 of the frame 22*a* along the z direction against surfaces 264, 266 of the printbar 220 using a spring plunger 268 and a shoulder screw 270, respectively. The surfaces 264, 266 are substantially leveled in the same plane parallel to the x-y plane so that the arrays of nozzles of the jetting module 10 are horizontally parallel to they direction. The spring plunger 268 can have features, such as a spring constant, similar to the spring plunger 228. In some embodiments, the spring plunger 268 also has a curved contact head (not labeled) being in point contact with an upper surface 271 or extending into an alignment hole 272 of the end 260 (FIG. 11). A force exerted by the spring plunger 268 on the frame 22*a* along the z direction is about 10 N to about 40 N. The spring plungers 228, 268 can have their fixed to a standing element 225 that is screwed to the base plate 223 using screws 227. The shoulder screw 270 can have a body 274, a spring 276, and an insulating ring 278 arranged similarly to those of the shoulder screw 154 of FIG. 10. The body 274 is screwed into the printbar 220 without contacting the frame 22*a* and the spring 276 exerts a force of about 20 N to about 100 N on the frame 22 along the z direction. Both the spring plunger 268 and the shoulder screw 270 fastens the frame 22*a* to the printbar 220 without inducing a torque on the frame 22*a* so that the aligned angle θ is not affected. In some embodiments, the y-direction pixel adjustment and the orientation adjustment of the angle θ of the frame 22*a* can also be done in the manner described previously after the spring plunger 268 and the shoulder screw 270 are applied to the frame 22*a*.

In some embodiments, an insulating, e.g., thermally-insulating and/or electrically-insulating, sheet 282 can be applied on each top surface 264, 266 of the printbar 220 so that the ends 260, 262 of the frame 22*a* are thermally and/or electrically insulated from the printbar 220. Overall, among the portions or elements of/on the printbar 220, the frame 22*a* only directly contacts the contact heads 232, 234 of the spring plunger 228 and the adjustment screw 230 (y direction), the alignment datums 240*a*, 240*b* of the flexures 236*a*, 236*b*, the hard stops 238*a* and surfaces 239 (x direction), and the insulating sheets 282 (z direction). The contacts between the printbar 220 and the frame 22*a* in the x and y directions are minimal and the frame 22*a* is substantially thermally and electrically insulated from the printbar 220. The spring loading of the frame 22*a* in three directions x, y, and z allows the frame 22 to expand or shrink freely when experiencing thermal or other changes.

The base plate 223 of the printbar 220 can be made of a metal, for example, aluminum, e.g., cast aluminum (MIC-6 available from Alcoa at Pittsburgh, Pa.), stainless steel, e.g., 304 or 316 stainless steel, A2 tool steel, or stainless steel with coatings. The screws 227, 254, the body 270, and the tapered cones 252 can be made of stainless steel or other suitable materials. The spring plungers 228, 268 can have different shapes be commercially obtained, for example, from Monroe Engineering at Auburn Hills, Mich. The flexures 236*a*, 236*b* can be made of a plastic, for example, Acetal, which is commercially available as Delrin from Professional Plastics at Brooklyn Heights, Ohio, stainless steel, mild steel, or elastomeric materials. The insulating sheets 282 can also include a plastic, for example, phemolic, available from Electrical Insulating Material at Chambersburg, Pa., or Nomex Aramide paper available from Lucite International at Southampton, UK. Other suitable materials having similar properties can also be used for different components of the printbar 220.

In some embodiments, the four openings 222*a*-222*d* can be arranged in different configurations. The printbar 220 can include more than four openings, for example, five, six, or even more. The base plate 223 and the standing element 225 can be a continuously machined piece. Flexures or elastomeric profiles can be used in replacement of the spring plungers 228, 268 and vertically orientated expanding mandrels can be used in replacement of the tapered cones 252. The flexures 236*a*, 236*b* can have other shapes, for example, ramp-shaped, and can be arranged in a configuration different from the configuration shown in FIG. 18.

The printbar 220 also includes mechanisms, such as dowell pins 280, for aligning with other printbars 220 or mounting onto another printbar. The printbar 12, 220 can be a printbar of a step-and-repeat printer, in which the jetting module 10 scans back and forth across the substrate 16 along the x direction when the substrate 16 is stationary and the substrate 16 proceeds with a predetermined distance along the y direction between the scans. The printbar 12 can also be a printbar of a single-pass printer, in which the jetting module 10 stays stationary and prints on the substrate 16 that is moving along the x direction.

The resolution of the image 14 printed by the step-and-repeat printer or the single-pass printer is associated with the resolution at which the jetting module 10 is capable of printing but can also be increased by positioning multiple jetting modules 10 along the x direction to provide a desired high nozzle density along the y direction. Similar to the way the jetting assemblies 18, 20 are assembled on the frame 22, the nozzle arrays in one jetting module can include an offset along the x direction with respect to one or more nozzle arrays of other jetting modules mounted on the printbar 12 to increase the number of nozzles per inch along the y direction. In some embodiments, the multiple jetting modules can also be arranged in a similar way to that of the jetting assemblies 164, 166, 168, 170 to further increase the expansion of the nozzle arrays along they direction. A large expansion along they direction is desired in a single-pass printer when the image 14 has a large width.

The two jetting assemblies of the jetting module 10 can jet ink having the same color or each can jet ink having a color different from the color of the ink that the other one jets. Multiple, e.g., three, jetting modules 10 can also be used in the printer to print images with colors.

Jetting assemblies of different types can be used in the jetting module 10. Discussions of different types of jetting assemblies are provided in U.S. Pat. No. 5,265,315 and U.S. Ser. No. 12/125,648, filed May 22, 2008, the entire contents of each are incorporated herein by reference. Each portion of the frame 22 can be in a different shape or form and can be positioned at a different location, as long as the goal and/or manner of the positioning of the jetting assemblies on the frame 22 is not substantially affected. The alignment datums can be in forms other than high precision surfaces, for example, engageable protrusions and indents or others. The metal piece 74 and the flexure supports 78, 80 of FIGS. 3-5 can be a machined, continuous piece. The flexure supports 78, 80 can have various shapes, e.g., cylindrical, and thickness and can be located at positions different from those shown in FIGS. 1 and 3. The metal piece 74, including the alignment datums, can also have configurations different from those shown in the figures. The flexures 46, 48 can also be in the form other than metal sheets, for example, springs. The different parts of metal sheet 104 of the flexure 102 (FIG. 4) can have different shapes other than rectangular, for example, oval, circular, or others. Positioning of the jetting assemblies is also described in U.S. Ser. No. 11/118,704, filed Apr. 29, 2005, U.S. Ser. No. 11/118,293, filed Apr. 29, 2005, U.S. Ser. No. 11/117,146, filed Apr. 27, 2005, and U.S. Ser. No. 12/058, 139, filed Mar. 28, 2008, the entire contents of each are incorporated herein by reference. The ink jetted by the jetting assemblies can include conductive inks, magnetic inks, or materials used in the fabrication of light emitting diode (LED) displays. The jetting assemblies can be also used to dispense or deposit fluids other than ink onto a substrate. The fluids can include non-image forming fluids. For example, three-dimensional model pastes can be selectively deposited to build models. Biological samples can be deposited on an analysis array.

Other embodiments are also within the scope of the following claims.

What is claimed is:

1. An apparatus comprising:

features to enable mounting first and second jetting assemblies on a frame, the features comprising first and second alignment datums pre-fixed with respect to the frame for establishing respective positions of the first and second jetting assemblies, when mounted, so that at least some of the nozzles along a length of one of the jetting assemblies have predetermined offsets relative to at least some of the nozzles along a length of the other of the jetting assemblies, an opening exposing all of the nozzles along the lengths of the first and second jetting assemblies are exposed to permit jetting of a fluid onto a substrate, and at least one fastener for the first and second jetting assemblies.

2. The apparatus of claim 1 in which the fastener includes a piece to fix the fastener to the apparatus and a resilient piece to exert forces on the jetting assemblies.

3. The apparatus of claim 2 in which the fastener comprises a screw and the resilient piece comprises a spring.

4. The apparatus of claim 2 in which the resilient element is the only portion of the fastener that contacts the first jetting assembly.

5. The apparatus of claim 2 in which the resilient element exerts a force of about 2 pounds to about 10 pounds on the jetting assembly.

6. The apparatus of claim 5 in which the resilient element exerts a force of about 5 pounds on the jetting assembly.

7. The apparatus of claim 1 in which the fastener imposes no torque on the jetting assemblies.

8. The apparatus of claim 1 in which the frame is coated with a Teflon-nickel coating including a homogeneous mixture of Teflon and nickel.

9. The apparatus of claim 8 in which the coating has a thickness of about 2 microns to about 8 microns.

10. The apparatus of claim 1 in which the features also include at least one flexure corresponding to the first or second alignment datum.

11. The apparatus of claim 1 in which the features also include additional alignment datums for establishing respective positions of the jetting assemblies along a direction perpendicular to the length of the jetting assemblies.

12. The apparatus of claim 1 in which the frame comprises a precision surface and the fastener is configured to apply a force on the first jetting assembly in a jetting direction to hold the first jetting assembly firmly against the precision surface of the frame in at least one point, the fastener permitting torque-free motion of at least a portion of the first jetting assembly, relative to the frame, around an axis that lies in the jetting direction.

13. The apparatus of claim 12 in which the fastener comprises helical threads for fastening the first jetting assembly to the frame.

14. The apparatus of claim 1, further comprising a resilient sheet metal flexure between the frame and an end of the first jetting assembly, the flexure having a fastened end connected to a free end at a bend to exert a force along the length of the first jetting assembly toward the end of the first jetting assembly against the first alignment datum on the frame.

15. The apparatus of claim 14 in which the flexure has a spring constant of about 200 pounds per inch to about 600 pounds per inch.

16. The apparatus of claim 14 in which the flexure exerts a force of about 5 pounds to about 20 pounds on the first jetting assembly.

17. The apparatus of claim 14 in which the free end of the flexure includes an additional bend that contacts the first jetting assembly.

18. The apparatus of claim 17 in which the free end of the flexure includes a distal end beyond the additional bend, the distal end extending in a direction opposite to the location of the first jetting assembly.

19. The apparatus of claim 18 in which frame comprises a stop surface to stop the distal end of the flexure.

20. The apparatus of claim 19 in which the distal end is about 600 microns to about 1000 microns from the stop surface on the frame.

21. The apparatus of claim 17 in which the additional bend is about 3.0 mm to about 3.3 mm from a surface of the fastened end of the flexure.

22. The apparatus of claim 1 in which the frame that comprises a metal and a coating that is thermally and electrically conductive and chemically resistant to the fluid.

23. The apparatus of claim 22 in which the coating includes Teflon, nickel, chromium nickel nitride, or the combination of two or more of them.

24. The apparatus of claim 22 in which the coating has a thickness of about 2 microns to 10 microns.

25. The apparatus of claim 22 in which a surface of the coating has a friction co-efficient of less than 0.35.

26. An apparatus comprising:

features to enable mounting first and second jetting assemblies on a frame, the features comprising first and second alignment datums pre-fixed with respect to the frame for establishing respective positions of the first and second jetting assemblies, when mounted, so that at least some of the nozzles along a length of one of the jetting assemblies have predetermined offsets relative to at least some of the nozzles along a length of the other of the jetting assemblies, an opening exposing all of the nozzles along the lengths of the first and second jetting assemblies are exposed to permit jetting of a fluid onto a substrate, and at least one flexure corresponding to the first or second alignment datum.

27. The apparatus of claim 26 in which the frame is coated with a Teflon-nickel coating including a homogeneous mixture of Teflon and nickel.

28. The apparatus of claim 27 in which the coating has a thickness of about 2 microns to about 8 microns.

29. The apparatus of claim 26 in which the flexure comprises a resilient sheet metal between the frame and an end of the first jetting assembly, the flexure having a fastened end connected to a free end at a bend to exert a force along the length of the first jetting assembly toward the end of the first jetting assembly against the first alignment datum on the frame.

30. The apparatus of claim 26 in which the flexure has a spring constant of about 200 pounds per inch to about 600 pounds per inch.

31. The apparatus of claim 26 in which the flexure exerts a force of about 5 pounds to about 20 pounds on the first jetting assembly.

32. The apparatus of claim 26 in which the free end of the flexure includes an additional bend that contacts the first jetting assembly and a distal end beyond the additional bend, the distal end extending in a direction opposite to the location of the first jetting assembly.

33. The apparatus of claim 32 in which frame comprises a stop surface to stop the distal end of the flexure.

34. An apparatus comprising:

features to enable mounting first and second jetting assemblies on a frame, the frame being coated with a Teflon-nickel coating including a homogeneous mixture of Teflon and nickel, and the features comprising first and second alignment datums pre-fixed with respect to the frame for establishing respective positions of the first and second jetting assemblies, when mounted, so that at least some of the nozzles along a length of one of the jetting assemblies have predetermined offsets relative to at least some of the nozzles along a length of the other of the jetting assemblies, and an opening exposing all of the nozzles along the lengths of the first and second jetting assemblies are exposed to permit jetting of a fluid onto a substrate.

35. The apparatus of claim 34 in which the coating has a thickness of about 2 microns to 10 microns.

36. The apparatus of claim 34 in which a surface of the coating has a friction co-efficient of less than 0.35.

* * * * *

UNITED STATES PATENT AND TRADEMARK OFFICE

CERTIFICATE OF CORRECTION

PATENT NO. : 8,517,508 B2
APPLICATION NO. : 12/496874
DATED : August 27, 2013
INVENTOR(S) : Amidon, Jr. et al.

It is certified that error appears in the above-identified patent and that said Letters Patent is hereby corrected as shown below:

Title Page 2, Column 2, item [56], Line 31, Delete "applicaion" and insert -- application --

Signed and Sealed this
Twenty-sixth Day of November, 2013

Margaret A. Focarino

Margaret A. Focarino
*Commissioner for Patents of the United States Patent and Trademark Office*